US006632132B1

(12) United States Patent
Kikuchi et al.

(10) Patent No.: US 6,632,132 B1
(45) Date of Patent: Oct. 14, 2003

(54) TORNADO TYPE INTAKE AND BLOWING DEVICE

(75) Inventors: Yoshimasa Kikuchi, Sakai (JP); Kunihiko Miyake, Sakai (JP); Yoshinori Narikawa, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 09/786,118

(22) PCT Filed: Jun. 28, 2000

(86) PCT No.: PCT/JP00/04229

§ 371 (c)(1),
(2), (4) Date: May 10, 2001

(87) PCT Pub. No.: WO01/07842

PCT Pub. Date: Feb. 1, 2001

(30) Foreign Application Priority Data

| | | |
|---|---|---|
| Jul. 1, 1999 | (JP) | 11-187651 |
| Oct. 8, 1999 | (JP) | 11-287769 |
| May 26, 2000 | (JP) | 2000-157112 |

(51) Int. Cl.[7] ..... B08B 15/02; F24F 9/00

(52) U.S. Cl. ..... 454/66; 126/299 D; 454/189; 454/235

(58) Field of Search ..... 454/66, 189, 245, 454/246, 247, 248, 234, 235; 126/299 D

(56) References Cited

U.S. PATENT DOCUMENTS

| | | | | | |
|---|---|---|---|---|---|
| 36,981 | A | * | 11/1862 | Kinnell | 454/242 |
| 1,329,803 | A | * | 2/1920 | Scherer | 454/247 |
| 2,185,919 | A | * | 1/1940 | Kurth | 454/248 |
| 3,487,767 | A | * | 1/1970 | Kristiansen | 454/235 |
| 4,043,257 | A | * | 8/1977 | Aaberg | 454/66 |
| 4,450,756 | A | * | 5/1984 | Kling | 454/67 |
| 4,856,419 | A | * | 8/1989 | Imai | 454/49 |
| 5,096,467 | A | * | 3/1992 | Matsui | 454/189 X |
| 5,263,897 | A | * | 11/1993 | Kondo et al. | 454/189 |
| 5,716,268 | A | * | 2/1998 | Strongin et al. | 454/66 |

FOREIGN PATENT DOCUMENTS

| | | | | |
|---|---|---|---|---|
| DE | 25 54 618 | * | 6/1976 | 454/66 |
| DE | 85 34 590 U | | 1/1987 | |
| JP | 63-29146 A | | 2/1988 | |
| JP | 210036 A | | 1/1990 | |
| JP | 2010036 | | 1/1990 | |
| JP | U4129044 | | 11/1992 | |
| JP | 4-129044 | | 11/1992 | |
| JP | 8-75208 A | | 3/1996 | |
| JP | 8-334253 A | | 12/1996 | |
| JP | 10-288371 A | | 10/1998 | |
| JP | 11-83097 | | 3/1999 | |
| JP | 11-83097 A | | 3/1999 | |
| JP | 2000320875 | | 11/2000 | |
| SU | 1213317 | * | 2/1986 | 454/66 |

* cited by examiner

*Primary Examiner*—Harold Joyce
(74) *Attorney, Agent, or Firm*—Birch, Stewart, Kolasch & Birch, LLP

(57) ABSTRACT

A tornado type air intake and blowing device has an exhaust port communicating with an exhaust duct, an air supply chamber which is provided so as to surround the exhaust port and to which air is supplied through an air supply inlet, and air blowing ports blowing air supplied into the air supply chamber by swirling the air from the outer periphery of the exhaust port diagonally downward, the air blowing ports being provided in a side wall part of the air supply chamber, whereby the exhaust port can be formed in the entire area of the lower opening surface of the air supply chamber, the outside diameter of the air supply chamber is sufficient if it is equal to an outside diameter corresponding to the required opening diameter of the exhaust port and, accordingly, a device body can be formed compact.

10 Claims, 38 Drawing Sheets

91
76
76a
92
71b
74
73
76
79a
71
79a
79a
79a

TORNADO TYPE INTAKE AND BLOWING DEVICE

This application is the national phase under 35 U.S.C. §371 of PCT International Application No. PCT/JP00/04229 which has an International filing date of Jun. 28, 2000, which designated the United States of America.

TECHNICAL FIELD

The present invention relates to a tornado type air intake and blowing device which enables air of a specified local area to be efficiently taken in without causing diffusion of the air by creating spiral flows in reverse directions to each other which are an outside blowoff direction and an inside intake direction.

BACKGROUND ART

As an effective ventilation method for efficient discharge of, for example, indoor air in a specified local area without diffusion, there has recently been proposed the so-called tornado type air intake and blowing device (see Japanese Patent Application No. H11-131041 as an example). A tornado type device as shown in FIG. 38 for example is provided with two ducts having an exhaust duct 2 and an air supply duct 5 which are penetrated between indoors and outdoors. Corresponding to these ducts, there are provided a funnel-shaped exhaust hood 1 having an exhaust port 1*a* and a doom-shaped air supply chamber 4 having an air blowing port 3 to constitute a two-layer inside and outside structure, respectively. The exhaust duct 2 is communicating with the exhaust port 1*a* at the center of a top plate portion 1*b* of the exhaust hood 1. On the other hand, an air supply inlet 5*a* of the air supply duct 5 is provided in an inclined and tangent direction on the upper side of the air supply chamber 4, and is communicating with an air spiral supply space 4*c*. The outside air introduced into the air spiral supply space 4*c* of the air supply chamber 4 through the air supply inlet 5*a* of the air supply duct 5 is spirally blown from the air blowing port 3 to the outer periphery of the specified local area to form an air curtain-like spiral flow F1. The air blowing port 3 has spiral flow generating stators 3*a*, 3*a* . . . provided around the exhaust port 1*a* on the lower side of the air supply chamber 4. At the same time of blowing the air, the air in the specified local area surrounded by the spiral flow F1 is sucked toward the exhaust port 1*a* on the side of the exhaust duct 2, that is, to the direction opposite to the air blown from the air blowing port 3 to the outer periphery of the specified local area. During air suction, a negative pressure is produced to allow a suction air vortex flow F2 to be formed, and the flow F2 ascends like a tornado in the exhaust port 1*a* direction, by which effective ventilation is implemented.

However, the tornado type air intake and blowing device having the above-stated structure has a following drawback.

That is, in the structure shown in FIG. 38, an opening plane of the exhaust port 1*a* in the exhaust hood 1 and an opening plane of the air blowing port 3 are both disposed together on the same plane on the lower side of the air supply chamber 4. Therefore, if an exhaust port 1*a* with a desired opening diameter D1 is installed to obtain high air-collecting performance, an outside diameter D2 of the air supply chamber 4 is required to include the opening diameter D1 and a width D3 of a decorative panel necessary for installing the air blowing port 3 (D2=D1+2×D3). This leads to excessive increase of the outside diameter of the air supply chamber 4, which makes downsizing of the device difficult.

DISCLOSURE OF INVENTION

In order to solve the above-stated drawback, an object of the present invention is to provide a tornado type air intake and blowing device downsized by disposing an air blowing port on a side wall of an air supply chamber or by offsetting in a vertical direction a position of an opening plane of the air blowing port on a lower side of the air supply chamber and a position of an opening plane of an air-collecting opening on an exhaust hood side.

In order to accomplish the above object, the present invention is structured having the following drawback-solving means.

1. A First Aspect of the Invention

A tornado type air intake and blowing device of the present invention provides a tornado type air intake and blowing device, comprising: an exhaust port communicating with an exhaust duct; an air supply chamber which is disposed to enclose the exhaust port and to which air is supplied through an air supply inlet; and an air blowing port spirally blowing air supplied to an inside of the air supply chamber from an outer periphery of the exhaust port diagonally downward, wherein the air blowing port is provided on a side wall of the air supply chamber.

According to this constitution, the exhaust port can be formed almost all over the lower side opening plane of the air supply chamber. Therefore, the outside diameter corresponding to a necessary opening diameter of the exhaust port turns out to be sufficient for the air supply chamber, which contributes to form a downsized device.

2. An Embodiment of the Invention

In the tornado type air intake and blowing device of this embodiment, air blowing ports are provided continuously on a circumference of the side wall of the air supply chamber.

According to this constitution, an airflow spirally blown from the air blowing ports form a plane-shaped flow from the beginning. Therefore, no gap is generated in the air curtain flow event in the vicinity of the exhaust port, which prevents leakage of exhaust air to the surroundings.

3. An Embodiment of the Invention

In the tornado type air intake and blowing device of this embodiment, air blowing ports are provided at a specified interval on a circumference of the side wall of the air supply chamber.

According to this constitution, therefore, it is possible to spirally blow air only by, for example, opening each air blowing port diagonally downward. Accordingly, the air blowing port can be formed with easy operation and low costs compared to the case where the air blowing port is continuously formed and a large number of spiral flow generating stators are disposed together for example.

4. An Embodiment of the Invention

In the tornado type air intake and blowing device of this embodiment, a separation facilitating guide for a blowoff airflow is provided under the air blowing ports.

Therefore, a blowoff airflow is efficiently separated and blown off smoothly by this constitution.

5. An Embodiment of the Invention

In the tornado type air intake and blowing device of this embodiment, an edge portion is disposed on a downstream side of the air blowing ports at a specified distance from the air blowing ports.

According to this constitution, therefore, a blowoff airflow blown from the air blowing ports is attached to the edge portion provided on the specified position on the downstream side. Accordingly, the blowoff airflow can be fixed to a specified direction without decreasing a velocity of the blowoff airflow, by which a stable spiral flow can be generated.

6. The Second Aspect of the Invention

The present invention also provides a tornado type air intake and blowing device as air conditioner comprising; an air suction port for air conditioning; an air passage provided around the air suction port for blowing intake air through a fan and a heat exchanger; and an air blowing port spirally blowing conditioned air passed through the air passage from an outer periphery of the air suction port diagonally downward, wherein the air blowing port is provided on a side wall of a body casing for the air conditioner.

According to this constitution, it is possible to form the air suction port as wide as possible over the lower side opening plane of the body casing. Therefore, the outside diameter corresponding to the necessary opening diameter of the air suction port, diameter of the fan, width of the heat exchanger, and the like is eventually sufficient for the body casing, by which the body of the air conditioner can be formed downsized.

7. The Third Aspect of the Invention

The present invention also provide a tornado type air intake and blowing device, comprising: an exhaust hood having an air-collecting opening communicating with an exhaust duct; an air supply chamber which is disposed to cover a top of the exhaust hood and to which air is supplied through an air supply inlet; and an air blowing port spirally blowing the air supplied to an inside of the air supply chamber from an outer periphery of the exhaust hood diagonally downward, wherein an opening plane of the air blowing port and an opening plane of an air-collecting opening of the exhaust hood are offset to each other in a vertical direction.

According to this constitution, it is possible to form the air-collecting opening of the exhaust hood whose opening area is approximately equal to the opening area of the lower side opening plane of the air supply chamber without enlarging the outside diameter of the air supply chamber. Therefore, the outside diameter corresponding to necessary opening diameter of the exhaust port is eventually sufficient for the air supply chamber, which enables to form a downsized device.

8. An Embodiment of the Invention

In the tornado type air intake and blowing device of this embodiment, the air blowing port is provided between a side wall of the exhaust hood and a lower end opening edge portion of the air supply chamber placed above the exhaust hood.

More specifically, in the constitution of the above embodiment, against the exhaust hood having the air-collecting opening communicating with the exhaust duct as stated above, the air supply chamber to which air is supplied through the air supply inlet is disposed offset in the upper direction so as to cover the upper portion of the exhaust hood. As a result, between the side wall of the exhaust hood and the lower end opening edge portion of the air supply chamber, there is formed an adequate space for placing the air blowing port which blows the air supplied into the air supply chamber by whirling the same from the outer periphery of the exhaust hood in an inclined direction.

By utilizing this space, therefore, the above-stated air blowing port can be formed effectively.

9. An Embodiment of the Invention

In the tornado type air intake and blowing device of this embodiment, an edge portion is disposed on a downstream side of the air blowing port at a specified distance from the air blowing port.

According to this constitution, a blowoff airflow blown from the air blowing port is attached to the edge portion on the specified position on the downstream side. Therefore, a direction of the blowoff airflow can be fixed to a specified direction without decreasing the velocity of the blowoff airflow, by which a stable spiral flow can be generated.

10. An Embodiment of the Invention

In the tornado type air intake and blowing device of this embodiment, the edge portion is provided on an outer peripheral side of the exhaust hood.

According to this constitution, therefore, a blowoff direction of the blowoff airflow, which is blown from the air blowing port to the lower part of the outer periphery of the exhaust hood, is adequately controlled to a specified direction by the edge portion provided on the outer periphery of the exhaust hood, by which a stable spiral flow can be generated.

11. An Embodiment of the Invention

In the tornado type air intake and blowing device of this embodiment, a lower end of the air-collecting opening of the exhaust hood is extended and positioned lower than the edge portion.

In the case where the edge portion is provided on the outer peripheral side of the exhaust hood as seen in the constitution of the above-stated embodiment of 10, and the edge portion 14 is, for example, on the opening plane of the air-collecting opening in the exhaust hood, an upward spiral airflow on the outer peripheral side to be collected is imparted larger component of velocity to the radial outer side. Therefore, the airflow becomes prone to leak to the outside of the exhaust hood 10, so that the air collecting efficiency in an exhaust direction is decreased.

However, when the lower end of the air-collecting opening in the exhaust hood is extended and disposed lower than the edge portion, it can be ensured that the air is intercepted and guided to the side of the air-collecting opening in the exhaust hood before it is imparted larger component of velocity to the radial outer side. Accordingly, the air collecting efficiency in an exhaust direction can be increased.

12. The Fourth Aspect of the Invention

The present invention also provides a tornado type air intake and blowing device, comprising: an exhaust port for taking indoor air; and air blowing ports spirally blowing air from an outer periphery of the exhaust port diagonally downward, wherein the air blowing ports are provided on a side portion of the device.

According to this constitution, therefore, the air blowing port is provided on the side portion of the device, as a result of which the exhaust port can be formed almost all over the lower side opening plane of the device. At the same time, the outside diameter corresponding to necessary opening diameters of the exhaust ports turns to be sufficient for the device, which contributes to form a downsized device.

13. An Embodiment of the Invention

In the tornado type air intake and blowing device of this embodiment, an outer peripheral edge of the air blowing port is positioned higher than an air suction plane of an intake hood provided to surround the exhaust port, and positioned inside of the outer peripheral edge thereof.

According to this constitution, therefore, a blowoff direction of the spiral airflow which is blown from the air blowing port to the lower portion of the outer periphery of the intake hood is adequately controlled to a radial inner side by outer peripheral edge on the lower side of the intake hood, by which a stable spiral flow can be generated.

14. An Embodiment of the Invention

In the tornado type air intake and blowing device of this embodiment, the air blowing port and the exhaust port are placed offset to each other in vertical reverse directions along a vertical central axis.

According to this constitution, therefore, the interconnected disposition structure between the air blowing port and the intake hood similar to the invention shown in the above-stated is easily implemented.

15. An Embodiment of the Invention

In the tornado type air intake and blowing device of this embodiment, the air blowing ports are continuously provided in a circumferential direction of the device.

According to this constitution, therefore, an airflow spirally blown from the air blowing ports forms a plane-shaped flow from the beginning, and no gap is generated in the air curtain flow event in the vicinity of the exhaust port, which prevents leakage of exhaust air to the surroundings.

16. An Embodiment of the Invention

In the tornado type air intake and blowing device of this embodiment, the air blowing ports are provided at a specified interval in a circumferential direction of the device.

According to this constitution, therefore, it is possible to spirally blow air only by, for example, opening the air blowing ports diagonally downward, by which the air blowing port can be formed with easy operation and low costs compared to the case where the air blowing port is continuously formed as shown in the above embodiment and for example, a number of spiral flow generating stators should be disposed together.

17. An Embodiment of the Invention

In the tornado type air intake and blowing device of this embodiment, a separation facilitating guide for a blowoff airflow is provided around the air blowing ports.

According to this constitution, therefore, a blowoff airflow blown from the air blowing port is efficiently separated and blown off smoothly.

18. An Embodiment of the Invention

In the tornado type air intake and blowing device of this embodiment, an edge portion is disposed on a downstream side of the air blowing port at a specified distance from the air blowing port.

According to this constitution, therefore, a blowoff airflow blown from the air blowing port is attached to the edge portion on the specified position on the downstream side. Accordingly, a direction of the blowoff airflow can be fixed to a radial inner side without decreasing the velocity of the blowoff airflow, and thereby a stable spiral flow can be generated.

19. An Embodiment of the Invention

In the tornado type air intake and blowing device of this embodiment, the edge portion is disposed on an outer peripheral side of the intake hood.

According to this constitution, the edge portion is provided on such a specified downstream position that is an outer peripheral edge of the intake hood. Therefore, a blowoff direction of the spiral airflow, which is blown from the air blowing port to the lower part of the outer periphery of the intake hood, is adequately controlled to a radial inner side by the edge portion. A stable spiral flow can be generated by this edge portion.

20. An Embodiment of the Invention

In the tornado type air intake and blowing device of this embodiment, a lower end of an air-collecting opening is extended and positioned lower than the edge portion.

In the case where the edge portion of the intake hood is provided on the outer peripheral side of the intake hood, as seen in the constitution of the invention in the above-stated embodiment of 10, and the edge portion is, for example, on the opening plane of the air-collecting opening of the intake hood, an upward spiral airflow on the outer peripheral side to be collected is imparted a larger component of velocity to the radial outer side. Therefore, the airflow becomes prone to leak to the outside of the intake hood, and thereby the air collecting efficiency is decreased.

However, when the lower end of the air-collecting opening in the intake hood is extended and disposed lower than the edge portion, it is ensured that the air can be intercepted and guided to the side of the air-collecting opening in the intake hood before it is imparted a larger component of velocity to the radial outer side. Therefore, the air collecting efficiency in an exhaust direction can be increased.

21. An Embodiment of the Invention

In the tornado type air intake and blowing device in this embodiment, air cleaning means is provided inside the device so that air taken in from the air suction port is cleaned and thereafter blown from the air blowing port.

According to this constitution, therefore, the air blown from the air blowing port can be cleaned through the air cleaning means including, for example, electric precipitator, an air filter, and grease filter. Thereby, a spiral air curtain flow can be formed with clean air.

22. An Embodiment of the Invention

In the tornado type air intake and blowing device of this embodiment, a heat exchanger for air conditioning is provided inside an air passage in the device so that air passed through the heat exchanger to be conditioned is blown from the air blowing port.

According to this constitution, the air conditioned to a desired temperature can be blown from the air blowing port through the air-conditioning heat exchanger which is disposed inside an air passage in the device. Therefore, this device can be configured as an indoor equipment for air conditioning.

23. An Embodiment of the Invention

In the tornado type air intake and blowing device of this embodiment, when the device is installed in contact with or in vicinity of a wall, the air blowing port is sealed in an area where a stream of a spiral airflow blown from the air blowing ports provided all around the device is substantially disturbed.

According to this constitution, therefore, air is not blown from the wall side where the airflow becomes turbulent.

24. An Embodiment of the Invention

In the tornado type air intake and blowing device of this embodiment, a spiral air curtain flow is blown from opened air blowing ports positioned on a non-wall side when the device is installed in contact with or in vicinity of a wall.

According to this constitution, air is blown from no wall side where the airflow becomes turbulent, while at the same time, an adequate spiral airflow is blown from the non-wall side air blowing ports. Therefore, it is possible to form an air curtain-like spiral airflow which is as stable as possible as a whole.

25. An Embodiment of the Invention

In the tornado type air intake and blowing device of this embodiment, when the device is installed in vicinity of a wall, an open space from the wall to the device is sealed.

According to this constitution, the space itself between the device and the wall is sealed, and therefore which enables reliable sealing between the wall and the device between which the air curtain airflow is disturbed to be formed.

As is clear from the above description, the tornado type air intake and blowing device of the present invention makes it possible to downsize the device, and to perform efficient ventilation or circulation of inner air with a stable spiral airflow.

BEST MODE FOR CARRYING OUT THE INVENTION

Embodiment 1

Figure 1:
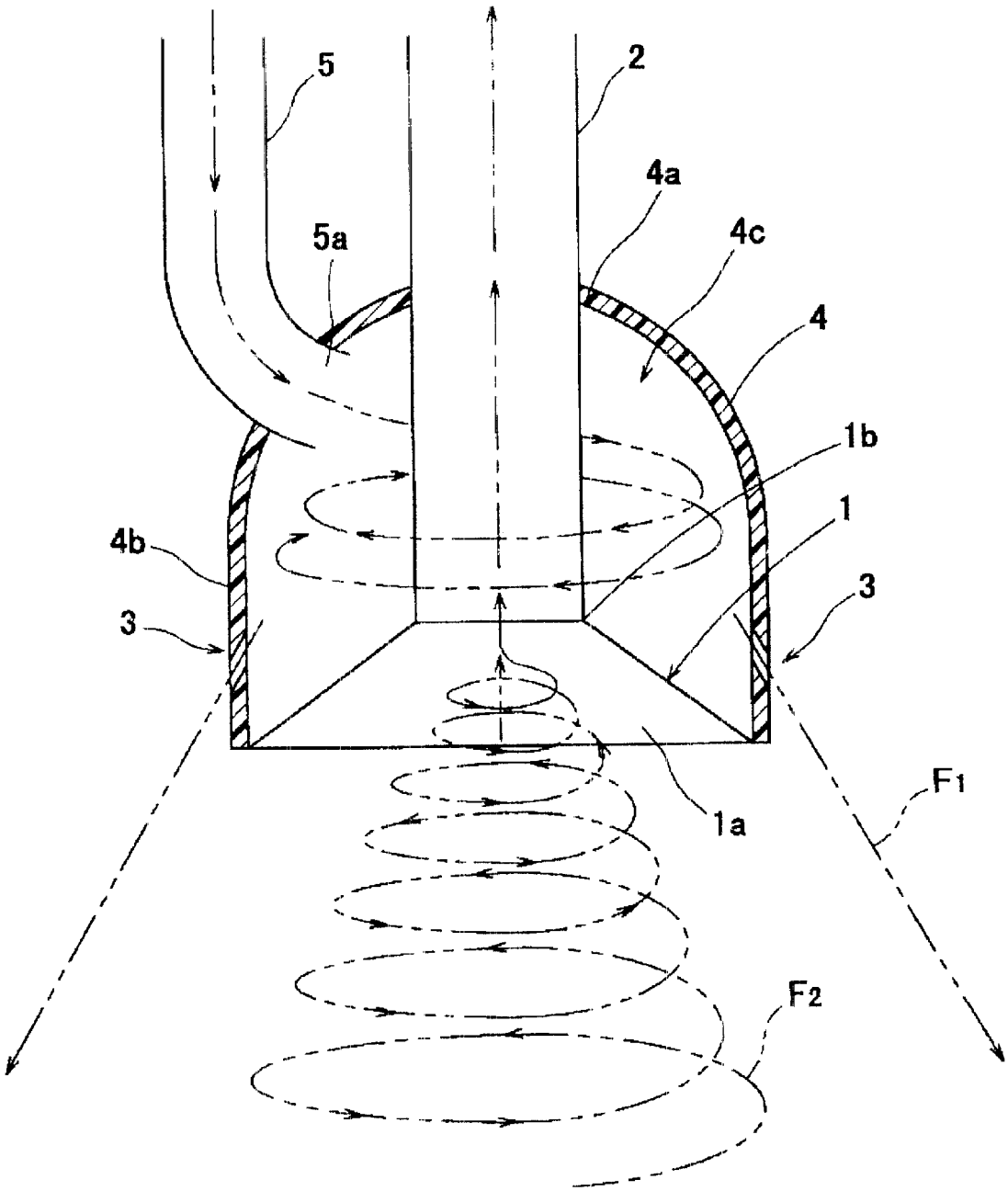
FIG. 1 is a cross sectional view showing constitution of a tornado type air intake and blowing device according to an embodiment 1 of the present invention.

FIGS. 1 through 4 show constitution of a tornado type air intake and blowing device suitable for a ventilator according to an embodiment 1 of the present invention.

This tornado type air intake and blowing device is installed above a specified local area, for example, a heating appliance for cooking such as a gas range table in a general household kitchen or a business-use kitchen for restaurants and the like. With this device, an outer periphery of the heating and cooking appliance is enclosed by an air curtain of a spiral airflow which is formed by outside air introduced from outdoors (or inside air taken from indoor space, or mixture of the outside air and the inside air, where necessary) and which is blown from above to below. At that time, within the air curtain of the spiral flow, a tornado type vortex flow is upwardly generated by an exhaust-directional suction with negative pressure which is worked toward a central portion inside the air curtain of the spiral flow. The tornado type spiral vortex upward flow effectively sucks smoke, odor and the like which are generated by the heating and cooking apparatus, and exhausts them to outdoors.

In the drawings, a numerical number 4 denotes an air supply chamber which is provided above a contaminated air source containing odor, smoke and the like, the air supply chamber being formed in a doom shape for example. In a lower inside portion of the air supply chamber 4, a funnel-shaped small-diameter exhaust hood 1 is provided at a specified distance from a top plate portion 4*a*, and extended to be integrated with an lower end of the air supply chamber 4. Accordingly, between the air supply chamber 4 and the exhaust hood 1, there is formed an air spiral supply space 4*c* whose passage diameter is gradually enlarged in centrifugal direction. In the air spiral supply space 4*c*, the outside air taken in through an air supply duct 5 is effectively spiraled and guided toward the air blowing port 3 as shown with arrows, so that a spiral flow having a preparatorily specified velocity is formed for the airflow supplied to the air blowing port 3. Current plates, which are positioned in the outer periphery of the upper part of the exhaust hood 1 inside the air spiral supply space 4*c*, are provided in order to regulate the spiral flow formed as described above, as needed. These current plates are made of, for example, a punching plate.

In addition, an air supply inlet 5*a* is located at an end of the air supply duct 5 curved so as to introduce the outside air in an inclined tangent direction (spiral direction), and is communicating with the top plate portion 4*a* side of the air supply chamber 4. On the other hand, an exhaust duct 2 is installed in a state of penetrating through the top plate portion 4*a* of the air supply chamber 4, and is communicating with the center of a top plate portion 1*b* of the exhaust hood 1. An outside air intake terminal of the air supply duct 5 and an inside air exhaust terminal of the exhaust duct 2 are each extensively provided outdoors. The extensively provided outdoor terminals of the air supply duct 5 and the exhaust duct 2, which are not illustrated, are equipped with an air supply fan and an exhaust fan made up of a sirocco fan for example, respectively. Driving of those fans perform the air supply function and the exhaust function, respectively.

Figure 2:
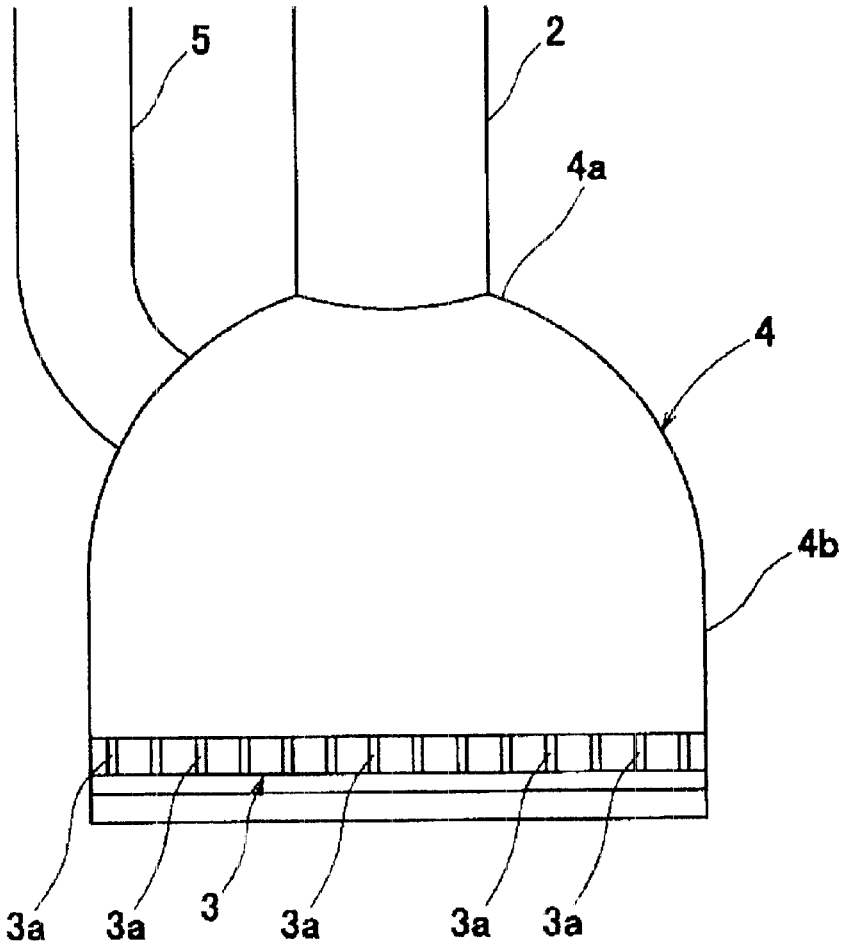
FIG. 2 is a front view showing the constitution of the same device.
Figure 3:
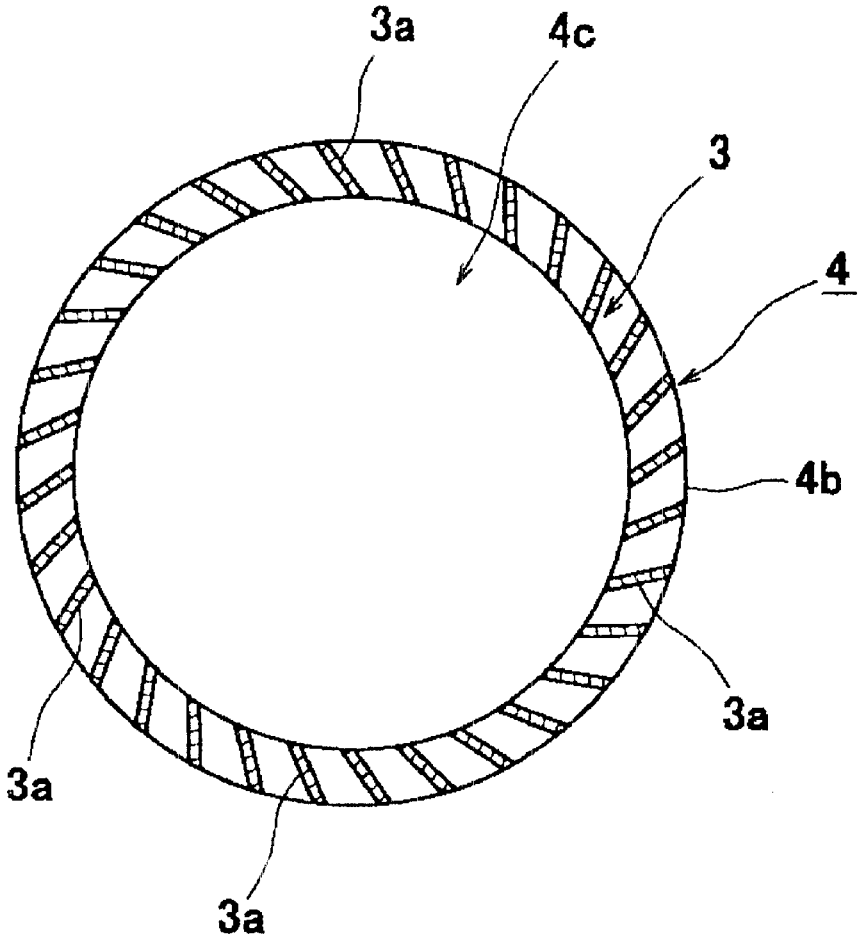
FIG. 3 is a cross sectional view showing constitution of a major portion of the same device.
Figure 4:
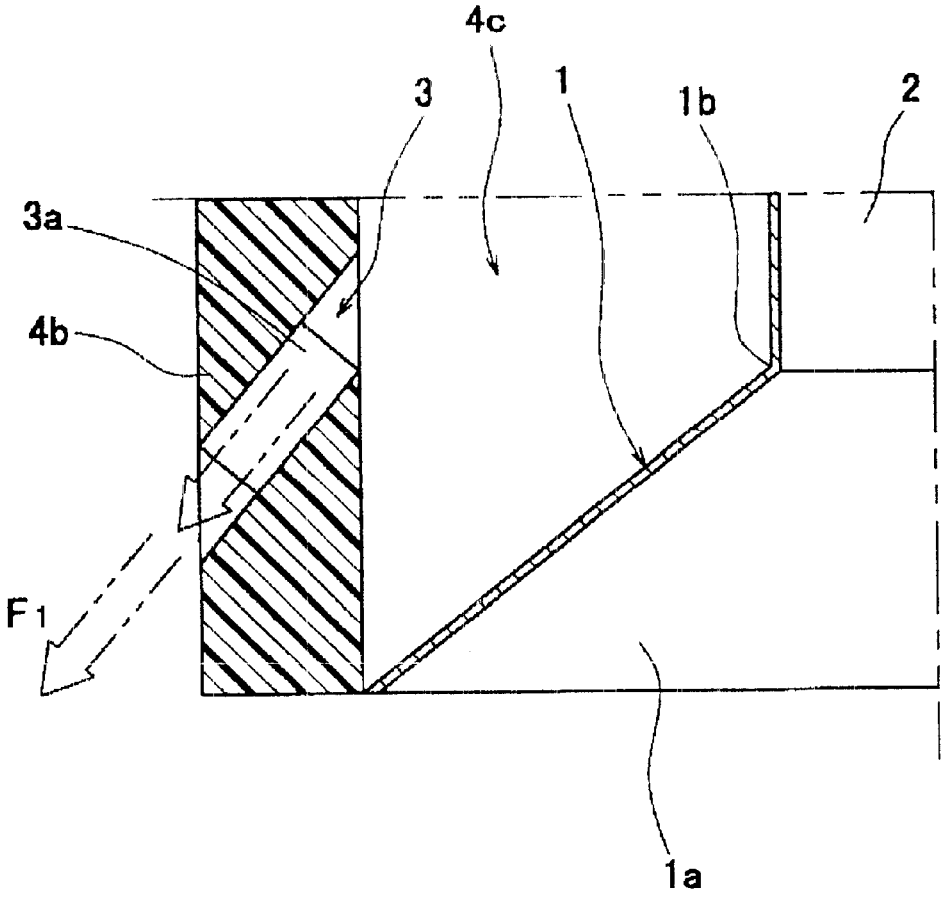
FIG. 4 is an enlarged fragmentary cross sectional view showing constitution of a major portion of the same device.

In the case of this embodiment, the air blowing ports 3 are located on the side wall 4*b* of a regular diameter part on the lower side of the air supply chamber 4, as shown in FIGS. 2 and 3 for example. The air blowing ports 3 are continuously open in a circumferential direction, and formed slantwise at a specified inclination angle from an upper position on the inside wall of the air supply chamber 4 to a lower position on the outside wall thereof. In air blowoff passage sections thereof, spiral flow generating stators 3*a*, 3*a* . . . are disposed together at specified intervals in the circumferential direction, and have a specified inclination angle in downward spiral direction.

Therefore, in the above constitution, if the air supply fan on the side of the air supply duct 5 and the exhaust fan on the side of the exhaust duct 2 are driven in the state of FIG. 1, the outside air introduced to the air supply inlet 5*a* through the air supply duct 5 by the air supply fan is firstly blown spirally within the air spiral supply space 4*c*. Then, the air is effectively spiraled within the air spiral supply space 4*c* and regulated by the current plates to make a stable spiral flow with a uniform flow velocity. Thereafter, the air is supplied to the air blowing ports 3 located on the side wall 4*b* of the lower part of the air supply chamber 4. Then, when the air passes through the air blowoff passages of the air blowing ports 3, larger vectors are each imparted to the air to be spiraled by the spiral flow generating stators 3*a*, 3*a* . . . to make a stronger spiral airflow F1. Consequently, the air is blown in the inclined direction toward the outer periphery of the heating and cooking appliance that is below in the local area.

As a result, due to the spiral blowoff airflow F1, there is created an air curtain which encloses smoke and odor coming from the heating and cooking appliance so as to prevent them from diffusing to the surroundings. At the same time, a tornado type spiral suction airflow F2 is created in central axis direction inside the air curtain. With a large suction force due to the suction force of the exhaust fan, the tornado type spiral suction airflow F2 ascends in the direction opposed to the airflow F1, that is, toward the exhaust port 1*a* inside the exhaust hood 1 located on the side of the exhaust duct 2.

Thereby, the contaminated air including smoke and/or odor in the heating and cooking appliance area is enclosed by the air curtain of the spiral blowoff airflow F1 to be reliably exhausted and cleaned out.

The tornado type air intake and blowing device of this embodiment, as mentioned above, comprises an exhaust port 1*a* communicating with an exhaust duct 2; an air supply chamber 4 which is disposed to enclose the exhaust port 1*a* and to which air is supplied through an air supply inlet 5*a*; and an air blowing port 3 spirally blowing air supplied to an inside of the air supply chamber 4 from an outer periphery of the exhaust port 1*a* diagonally downward, wherein the air blowing port 3 is provided on a side wall 4*b* of the air supply chamber 4.

According to this constitution, the exhaust port 1*a* can be formed almost all over the lower side opening plane of the air supply chamber 4. Therefore, the outside diameter corresponding to a necessary opening diameter of the exhaust port 1*a* turns out to be sufficient for the air supply chamber 4, which contributes to form a downsized device.

Also, in the same tornado type air intake and blowing device, the air blowing port 3 is continuously provided on a circumference of the side wall 4*b* of the air supply chamber 4.

According to this constitution, an airflow spirally blown from the air blowing port 3 forms a plane-shaped flow from the beginning. Therefore, no gap is generated in the air curtain flow event in the vicinity of the exhaust port 1*a*, which prevents leakage of exhaust air to the surroundings.

Further, in the same tornado type air intake and blowing device, a separation facilitating guide 13 for a blowoff airflow is provided around the air blowing port 3.

Therefore, the blowoff airflow from the air blowing port 3 is efficiently separated and blown off smoothly by this constitution.

As is clear from the above description, the tornado type air intake and blowing device in this embodiment enables to downsize the device, and to implement efficient ventilation.

Embodiment 2

Figure 5:
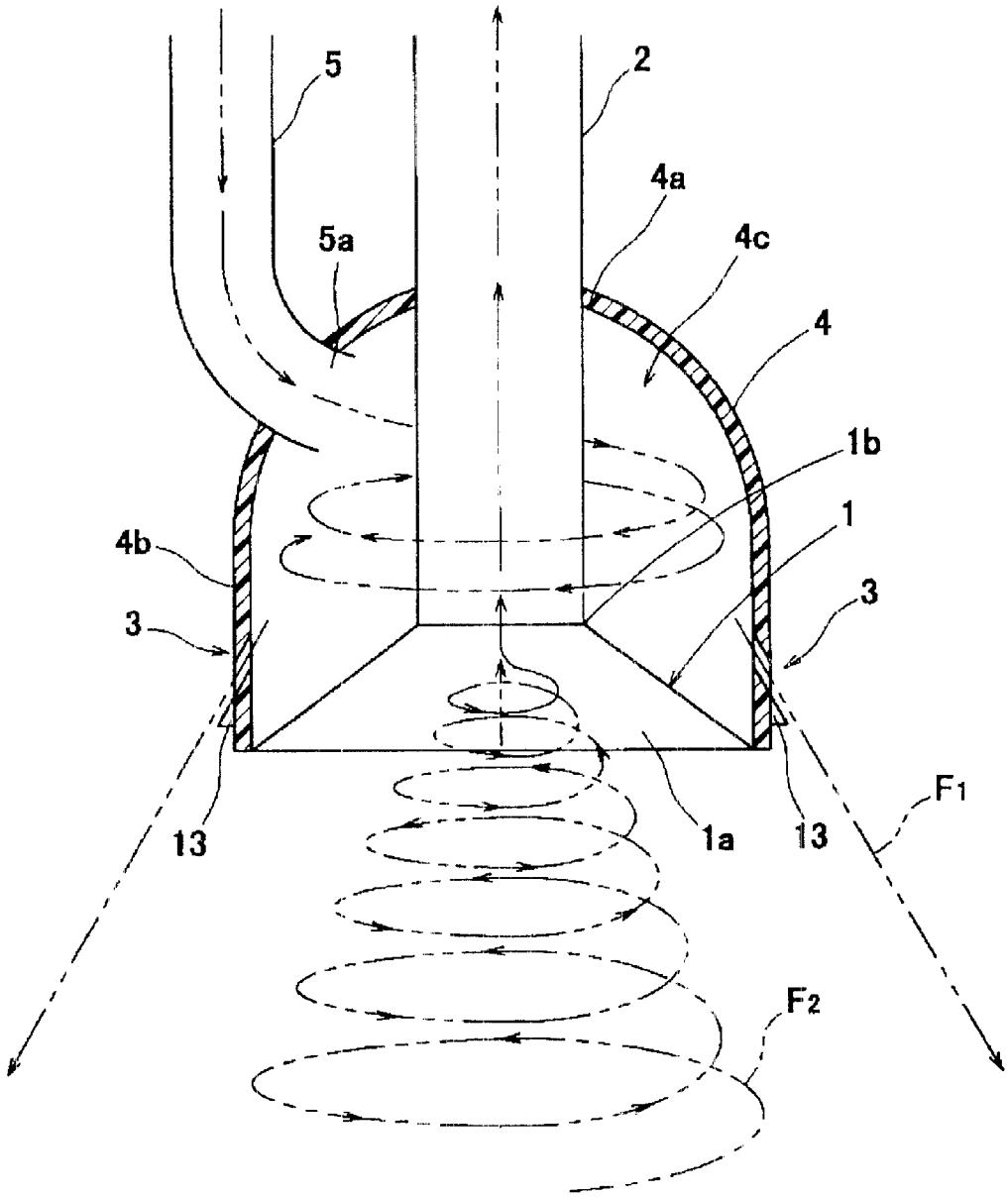
FIG. 5 is a cross sectional view showing constitution of a tornado type air intake and blowing device according to an embodiment 2 of the present invention.
Figure 6:
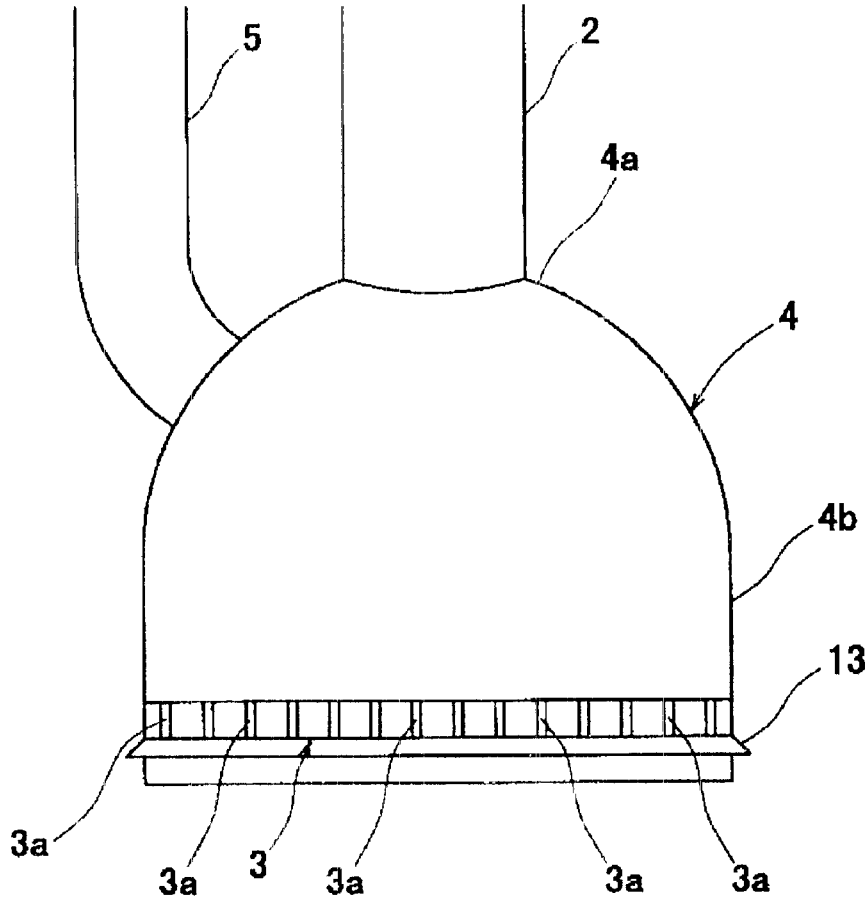
FIG. 6 is a front view showing the constitution of the same device.
Figure 7:
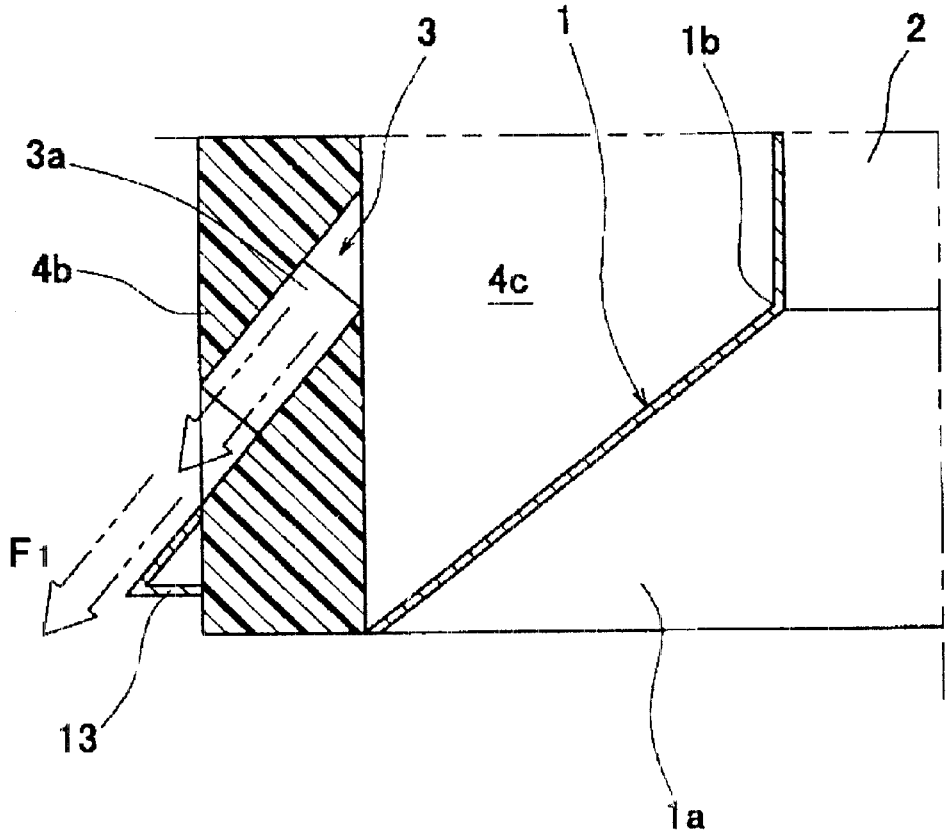
FIG. 7 is an enlarged fragmentary cross sectional view showing constitution of a major portion of the same device.

Next, FIGS. 5 through 7 show the constitution of a tornado type air intake and blowing device according to the embodiment 2 of the present invention applied to a ventilator.

In the case where the air blowing port 3 is disposed on the side wall 4*b* of the air supply chamber 4 as seen in the constitution of the above-stated embodiment 1, there is an drawback as to how to blow air smoothly from the air blowing port 3 which has relatively small passage length.

In the constitution of this embodiment as shown in FIGS. 5 through 7, therefore, the tornado type air intake and blowing device having the constitution of the above-stated embodiment 1 furthermore has a separation facilitating guide 13 for the blowoff airflow. The separation facilitating guide 13 is provided immediately under the air blowing port 3 so as to be formed on a plane continuously extended from the lowest portion of the air blowoff passage of the air blowing port 3. The separation facilitating guide 13 facilitates separation of the blowoff airflow toward the blowoff direction and prevents the blowoff airflow from attaching to the lower side of the side wall 4*b* of the air supply chamber 4. Thereby, smooth and efficient air blowing is enabled.

Figure 8:
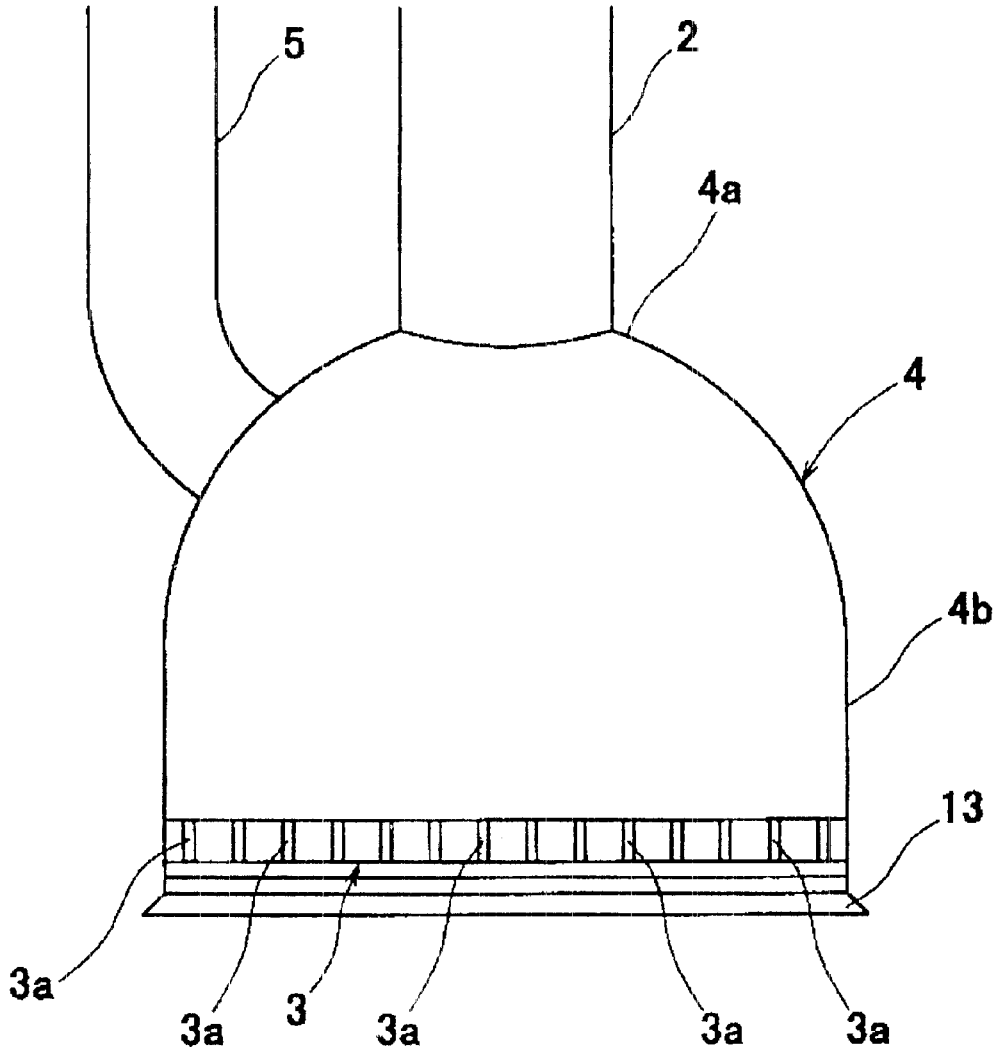
FIG. 8 is a front view showing constitution of a modified tornado type air intake and blowing device according to the embodiment 2 of the present invention.
Figure 9:
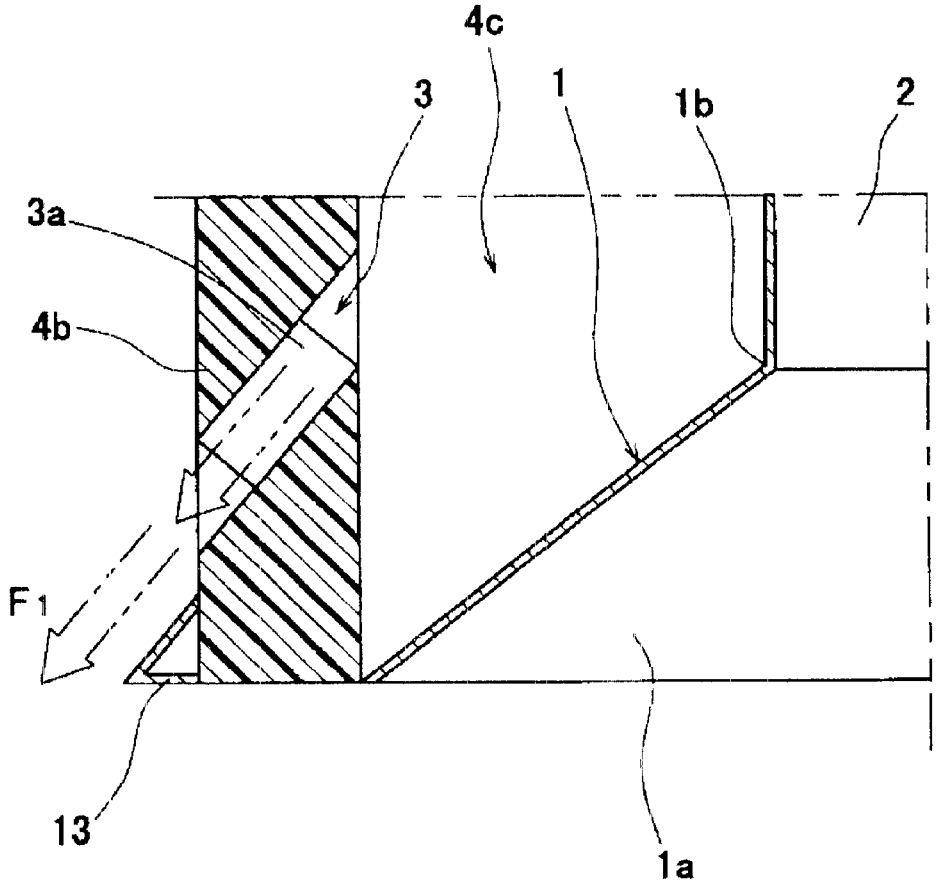
FIG. 9 is an enlarged fragmentary cross sectional view showing the constitution of a major portion of the same modified device.

Modified Embodiment:

It is noted that the above-stated separation facilitating guide 13 may be, for example, disposed on the outer periphery of the lower end of the side wall 4*b* in the air supply chamber 4, as shown in FIGS. 8 and 9.

Embodiment 3

Figure 10:
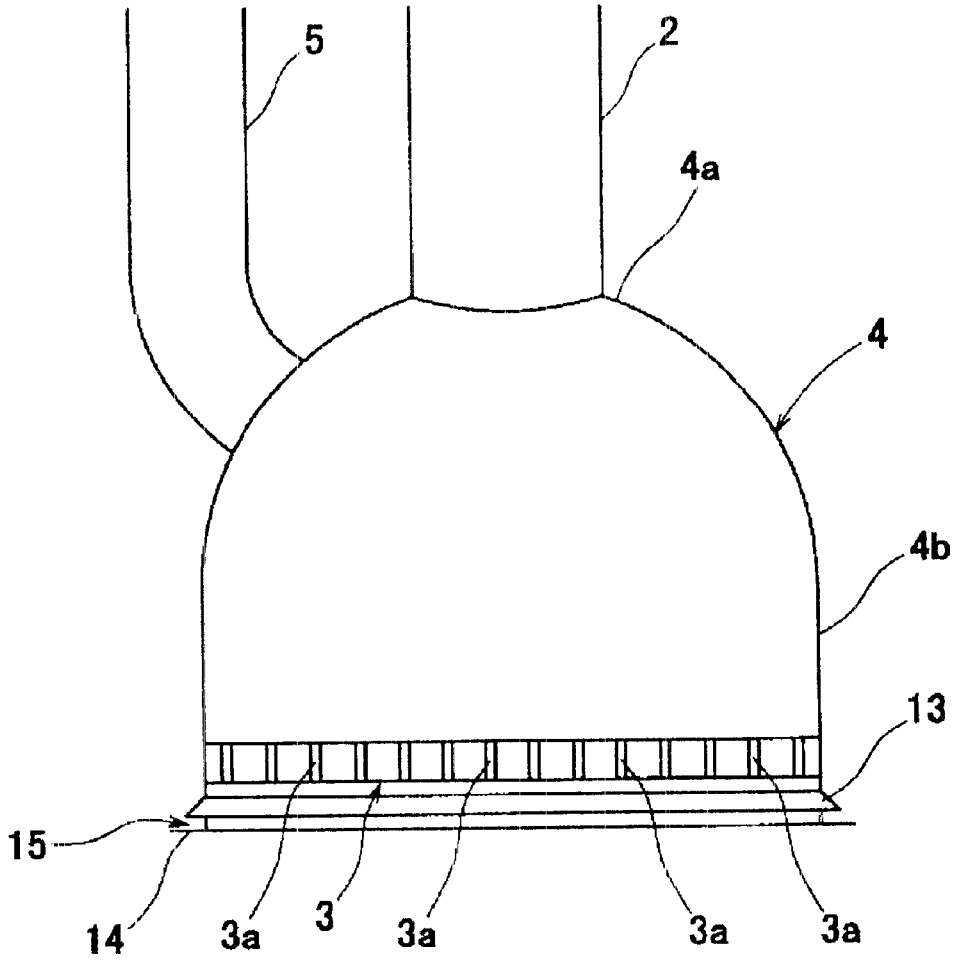
FIG. 10 is a front view showing constitution of a tornado type air intake and blowing device according to an embodiment 3 of the present invention.
Figure 11:
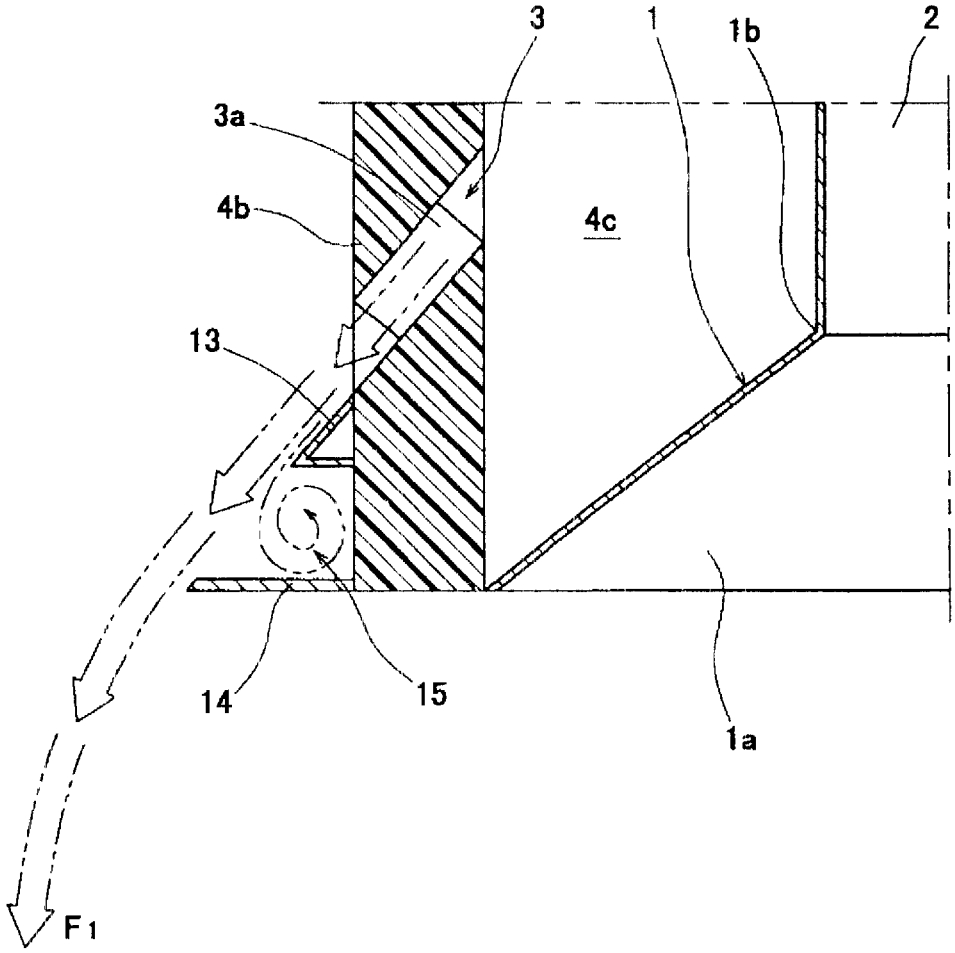
FIG. 11 is an enlarged fragmentary cross sectional view showing constitution of a major portion of the same device.

FIGS. 10 and 11 show the constitution of a tornado type air intake and blowing device according to the embodiment 3 of the present invention, which device is suitable for a ventilator.

As shown in the constitution according to each embodiment stated above, in the case where the air blowing port 3 is provided on the side wall 4*b* of the air supply chamber 4, there is an drawback as to how to converge and blow air downward smoothly from the air blowing port 3 which has relatively small passage length.

In the constitution of this embodiment, therefore, a tornado type air intake and blowing device has, similar to the tornado type air intake and blowing device in the constitution of above embodiment 2, a separation facilitating guide 13 for the blowoff airflow. The separation facilitating guide 13 is provided immediately under the air blowing port 3 so as to be formed on a plane continuously extended from the lowest portion of the air blowoff passage of the air blowing port 3. The separation facilitating guide 13 facilitates separation of the blowoff airflow toward the blowoff direction and prevents the blowoff airflow from attaching to the lower portion of the side wall 4*b* of the air supply chamber 4. Thus, smooth and efficient air blowing is enabled. At the same time, on the outer periphery of the lower end of the side wall 4*b* of the air supply chamber 4, there is provided an edge portion 14 which is projected from the outer periphery of the lower end of the side wall 4*b*. Width of the edge portion 14 is larger than that of the separation facilitating guide 13. Therefore, an airflow control space 15 is formed between the edge portion 14 and the separation facilitating guide 13 with specified spacing from the air blowing port 3. The blowoff airflow, which is blown from the air blowing port 3 and separation-facilitated by the separation facilitating guide 13, is dragged into the airflow control space 15 so as to form a Karman vortex and converged in a downward centripetal direction.

According to this constitution, a blowoff airflow blown from the air blowing ports 3 are attached to the edge portion 14. Therefore, a direction of the blowoff airflow can be fixed to a specified direction without decreasing the velocity of the blowoff airflow, by which a stable spiral flow can be generated.

According to the constitution, therefore, an effective spiral flow having high convergency can be formed smoothly.

Embodiment 4

Figure 12:
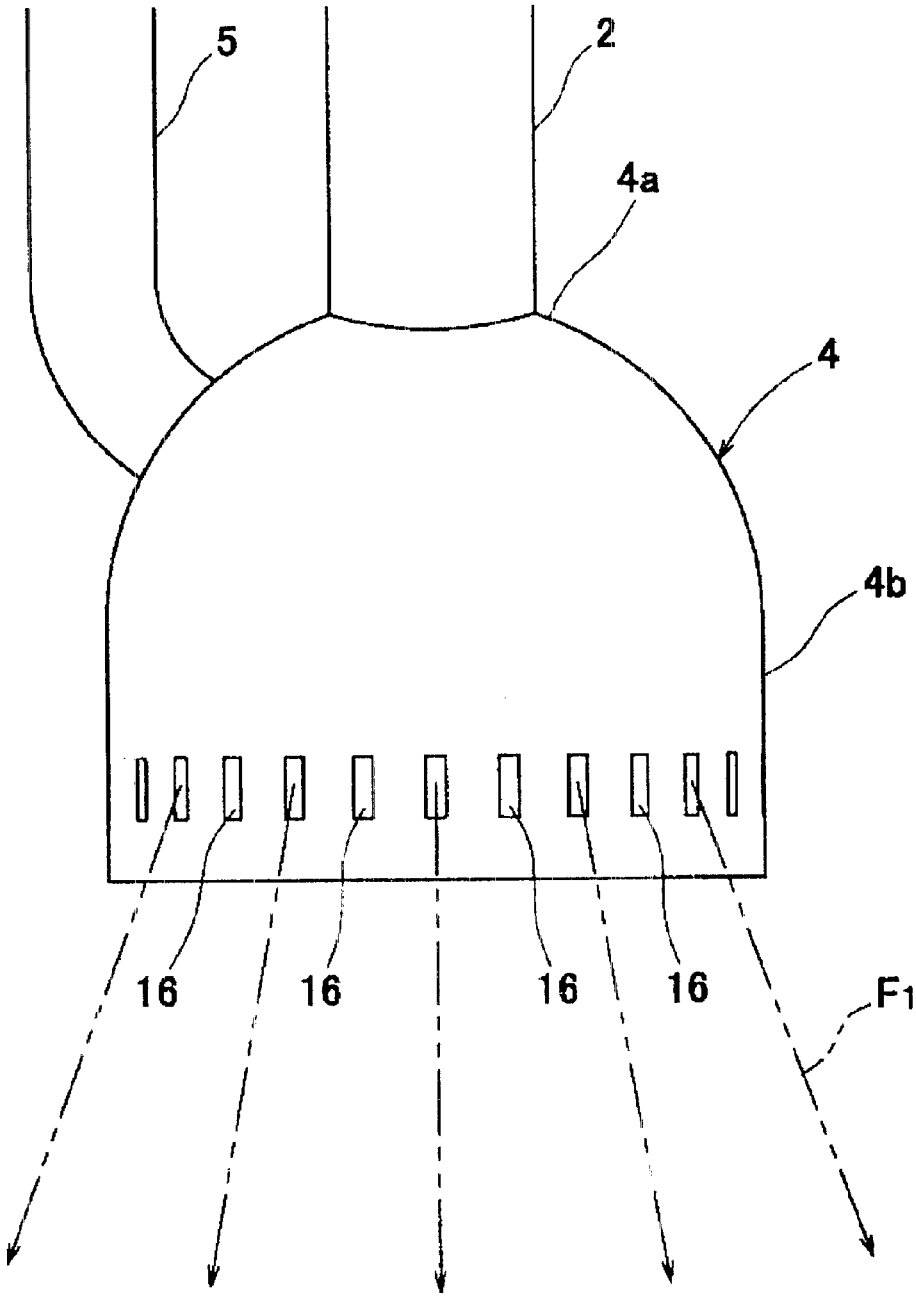
FIG. 12 is a front view showing constitution of a tornado type air intake and blowing device according to an embodiment 4 of the present invention.
Figure 13:
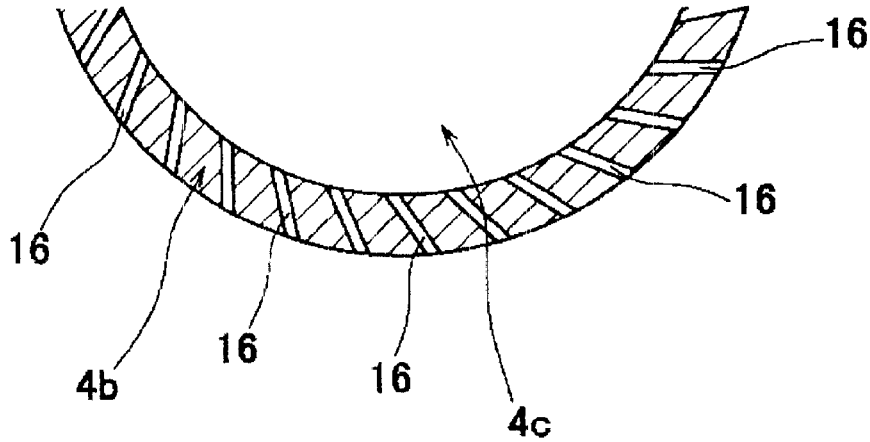
FIG. 13 is an enlarged fragmentary cross sectional view showing constitution of a major portion of the same device.

Next, FIGS. 12 and 13 show the constitution of a tornado type air intake and blowing device according to the embodiment 4 of the present invention, which device is suitable for a ventilator.

In the constitutions of the above embodiments 1 to 3, the air blowing ports 3 are continuously formed on the side wall 4*b* of the air supply chamber 4 in circumferential direction. Inside the air blowoff passage thereof, spiral flow generating stators 3*a*, 3*a* . . . are provided with an angle of inclination. In such constitutions, the structure turns out to be complex, and producing costs increase.

Accordingly, in this embodiment as shown, for example, in FIGS. 12 and 13, a plurality of air blowing ports 16 having a similar function as stated-above are disposed together on the side wall 4*b* of the air supply chamber 4 in the circumferential direction at specified intervals, where each port is so opened in a inclined downward direction as to spirally blow air.

According to the constitution, air can be spirally blown only by opening the air blowing ports 16, 16 . . . in the inclined downward direction. Therefore, the air blowing ports 16 can be formed with a simple structure and low costs compared to the case where openings are continuously formed in the circumferential direction with a large number of spiral flow generating stators 3*a*, 3*a* . . . disposed together as seen in the constitution of each embodiment stated above.

Embodiment 5

Figure 14:
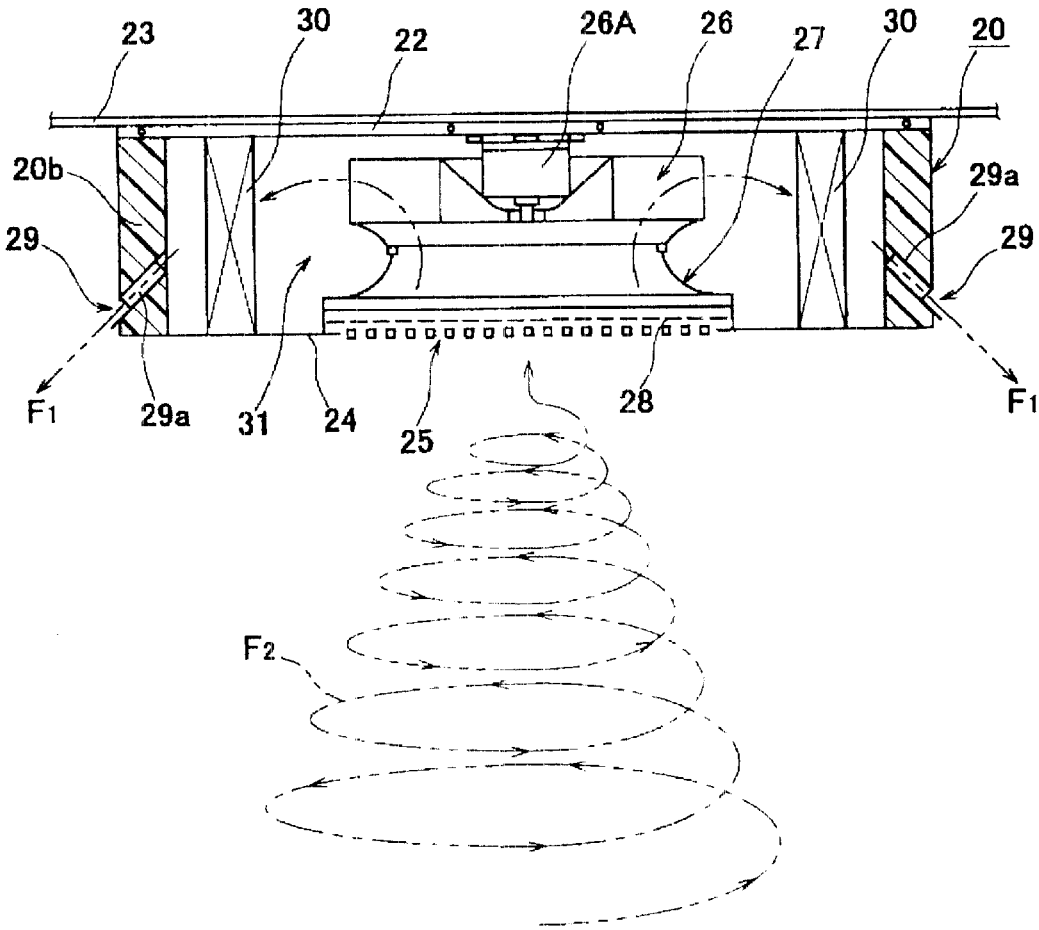
FIG. 14 is a front view showing constitution of a tornado type air intake and blowing device according to an embodiment 5 of the present invention.
Figure 15:
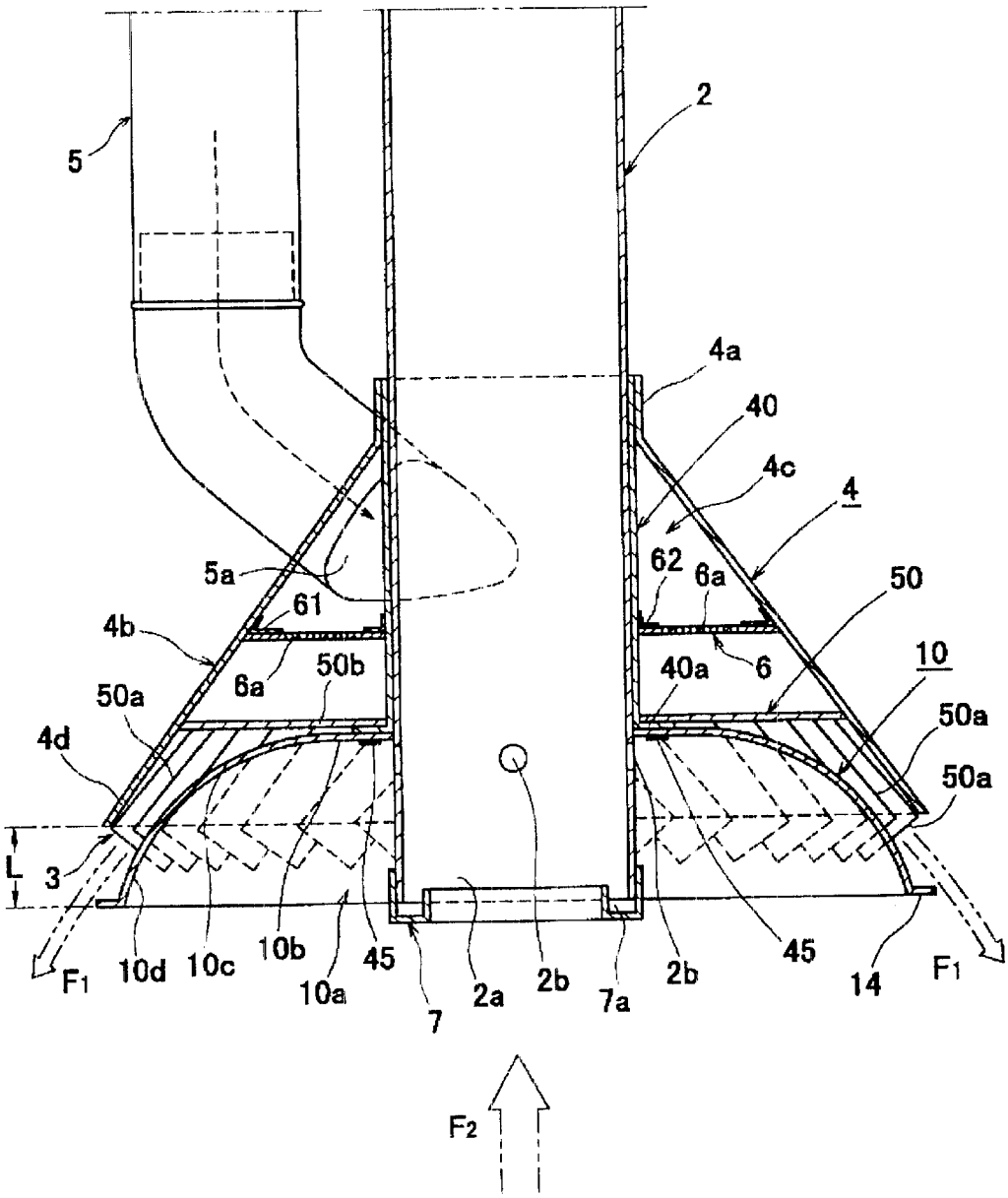
FIG. 15 is a cross sectional view showing constitution of a tornado type air intake and blowing device according to an embodiment 6 of the present invention.
Figure 16:
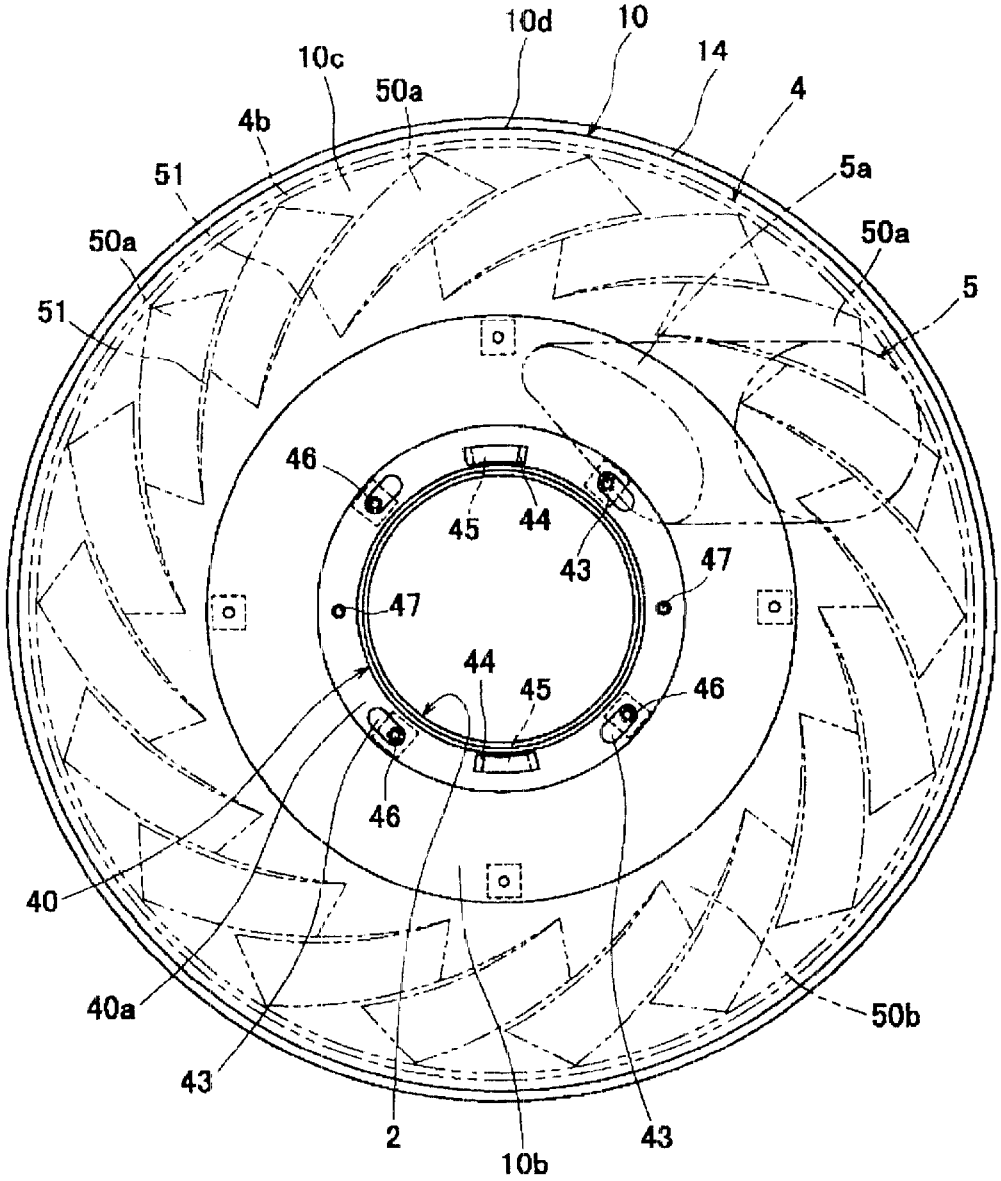
FIG. 16 is a plane view showing constitution of a major portion of the same device.
Figure 17:
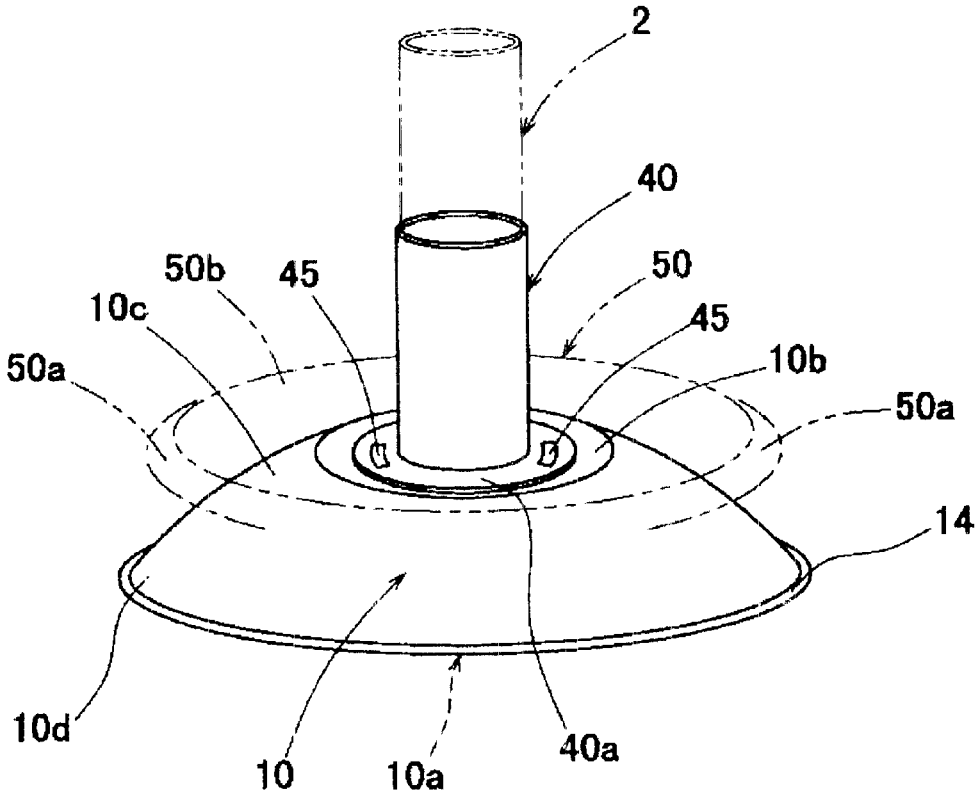
FIG. 17 is a perspective view showing constitution of a major portion of the same device.

Further, FIG. 14 shows a structure and operation of a tornado type air intake and blowing device according to the embodiment 5 of the present invention, which device is suitable for a ventilator.

In the drawing, firstly a numerical number 20 denotes a cassette-type body casing for a ceiling suspended-type air conditioner 1. In the body casing 20, a top plate 22 is, as shown in the drawing for example, integrally connected to a ceiling 23 and suspended therefrom.

An air suction grill 25, which is an air suction port, is provided in a central portion of a decorative panel 24 on the lower side of the body casing 20. A bell mouth 27 for a turbo fan 26 is provided to connect with the upper part of the air suction grill 25 via an air cleaning element 28, which is placed between the air suction grill 25 and the bell mouth 27.

In addition, similar to each embodiment stated above, air blowing ports 29 having spiral flow generating stators 29*a*, 29*a* . . . are disposed on a side wall 20*b* of the body casing 20.

The air blowing port 29 forms an air blowoff passage inclined in outer periphery direction at a specified angle downward, where the above-stated spiral flow generating stators 29*a*, 29*a* . . . are each provided at an angle of inclination toward the spiral direction at a specified interval.

Inside the body casing 20 with the above-stated constitution, there is formed an air passage 31 in all-around direction leading from the air suction grill 25, through the air cleaning element 28, the bell mouth 27, the turbo fan 26, and the heat exchanger 30 to the air blowing port 29. The turbo fan 26, which is located in the center area behind the air cleaning element 28 of the air passage 31 (upper part in the drawing) and whose air suction side (shroud side) is corresponding to the bell mouth 27, is suspended from the top plate 22 of the body casing 20 via a fan motor 26A.

When the turbo fan 26 is driven, therefore, indoor air in a specified local area under the air suction grill 25 is taken from the air suction grill 25 and cleaned through the air cleaning element 28, and after blown by the turbo fan 26 in outer peripheral direction and heat-exchanged by the heat exchanger 30, the air is imparted to vectors in spiral direction by the spiral flow generating stators 29*a*, 29*a* . . . in the air blowoff passage area of the air blowing ports 29 on the lower side of the body casing side wall 20*b*, and blown toward the flower below in inclined direction as a spiral flow.

As a result, the spiral blowoff airflow F1 creates a tornado type spiral suction airflow F2 toward central axis direction inside the airflow F1, which has large suction force and ascends in the direction opposed to the airflow F1 due to the suction force of the turbo fan 26.

This enables reliable air conditioning and cleaning of the air in a specified local area enclosed with the air curtain composed of the spiral blowoff airflow F1.

A tornado type air intake and blowing device as an air conditioner according to the present embodiment comprises: an air suction grill 25 for air conditioning; an air passage 31 provided around the air suction grill 25 for blowing intake air through an air cleaning element 28, a turbo fan 26, and a heat exchanger 30; and air blowing port 29 which spirally blows the air conditioned and cleaned through the air passage 31 from the outer periphery of the air suction grill 25 diagonally downward, wherein the air blowing port 29 is provided on a side wall 20*b* of a body casing 20 for the air conditioner.

According to this constitution, therefore, it is possible to form the air suction grill 25 as wide as possible over the lower side opening plane of the body casing 20 as illustrated, so that the outside diameter corresponding to the necessary opening diameter of the air suction grill 25, diameter of turbo fan 26, width of the heat exchanger 30 or the like is eventually sufficient for the body casing 20, which enables to form a downsized body of the air conditioner.

It need scarcely be said that in the constitution of the present embodiment, the same constitution as shown in the embodiments 2 through 4 as stated above may be adopted for the air blowing port 29 portion.

Embodiment 6

FIGS. 15 through 19 show the constitution of a tornado type air intake and blowing device according to the embodiment 6 of the present invention applied to an ventilator.

This tornado type air intake and blowing device is, as one example, installed on a specified local area, like the upper portion of a heating and cooking appliances such as gas range tables in general household kitchens or business-use kitchens for restaurants and the like. With this device, an outer periphery of the heating and cooking appliance are enclosed with an spiral flow F1 from the upper side to the lower side produced by the outside air introduced from outdoors like an air curtain, and at the same time, a tornado type spiral flow F2 is generated in upward direction within the air curtain-like spiral flow F1 with a suction negative pressure in an exhaust direction worked on the center portion inside the air curtain-like spiral flow F1. Smoke, odor or the like generated by the heating and cooking apparatuses or the like in the specified local area can be effectively sucked and exhausted outdoor by using this upward spiral vortex flow.

In FIGS. 15 through 19, firstly a numerical number 4 denotes, for example, an approximately conical air supply chamber provided on the upper section of a source of contaminated air containing odor and smoke. Inside lower part of the air supply chamber 4, with a specified spacing there is provided a relatively small depth funnel-shaped exhaust hood 10 in exhaust direction in a de-mountable manner, which is placed offset in vertical direction against the air supply chamber 4 with an opening edge lower end 10*d* of the air-collecting opening 10*a* being projected downward by a specified dimension L from the lower end opening plane of the air supply chamber 4 (described later) Accordingly, between the air supply chamber 4 and the exhaust hood 10 inside thereof, there is formed an air spiral supply space 4*c* whose passage diameter is gradually enlarged in traveling direction for effectively spiraling and guiding the outside air taken in through an air supply inlet 5*a* of an air supply duct 5 described later, toward the air blowing port 3, by which an airflow to be supplied to the air blowing port 3 is preparatorily formed as a spiral flow with a specified velocity.

Inside the air spiral supply space 4*c*, there is provided a current plate 6 in the upper part of the exhaust hood 10, the current plate 6 having a number of airflow regulating holes 6*a*, 6*a* . . . for regulating the spiral flow formed as stated above and unifying flow velocity distribution thereof. The current plate 6 is made of, for example, a punching plate, and the inside and outside edges thereof are each attached to a sleeve (joint member) 40 on the outer periphery of the exhaust duct 2 described later and to the air supply chamber 4 with ring-shaped corner brackets 61 and 62 interposed, respectively.

In addition, a curved air supply inlet 5*a* formed at the top of the air supply duct 5 is communicating with the air supply chamber 4 side for introducing the outside air supplied from outdoors into the air spiral supply space 4*c* in an inclined tangent direction (spiral direction). Also communicating with the exhaust hood 10, through auxiliary exhaust ports 2*b*, 2*b* . . . , are an exhaust duct 2, which is installed penetrating through a cylindrical portion formed in the center of the top plate portion 4*a* of the air supply chamber 4 and through the sleeve 40 from the upper side to the lower side and being extensively provided (projected) to have a cylindrical shape so that an lower end exhaust port 2*a* thereof is positioned in the vicinity of the air-collecting opening 10*a* plane of the exhaust hood 10. An outside air intake terminal of the air supply duct 5 and an inside air exhaust terminal of the exhaust duct 2 are each extensively provided outdoors. The extensively provided outdoor terminals of the air supply duct 5 and the exhaust duct 2, which are not illustrated, are each equipped with an air supply fan and an exhaust fan made up of, for example, a sirocco fan, and the driving force of each fan implements corresponding air supply function and exhaust function, respectively.

The sleeve 40 into which the exhaust duct 2 can be inserted is fitted to the outer periphery of the exhaust duct 2 within the air spiral supply space 4*c*. Through the sleeve 40, spiral flow generating stators 50*a*, 50*a* . . . and the exhaust hood 10 as well as the above-mentioned current plate 6 are each integrated into the air supply chamber 4 as described later.

The exhaust duct 2 is also inserted into the sleeve 40 and so fixed that the opening position of the lower side exhaust port 2*a* is set to be an appropriate position for realizing sufficient exhaust function as described above.

In addition, auxiliary exhaust ports 2*b*, 2*b* . . . for sucking and exhausting the inside air collected in the air-collecting opening 10*a* of the exhaust hood 10, and an oil receiver 7 having U-shaped cross section including an oil receiving groove 7*a* are placed on the upper outside diameter of the exhaust port 2*a* of the exhaust duct 2 and the lower end thereof, respectively.

On the other hand, in the case of this embodiment, the air blowing ports 3 are formed by using a space between the inner peripheral surface of the lower end opening edge portion 4*d* of the air supply chamber 4 and the outer peripheral surface of the shoulder portion of the side wall 10*c* of the exhaust hood 10. The above-stated space is formed by offsetting the air supply chamber 4 and the exhaust hood 10 in vertical direction by a specified dimension L. The air blowing ports 3 are continuously opened annularly in all around direction with a specified passage length in blowoff direction and formed slantwise at a specified angle of inclination gradually enlarging the central diameter of the passage from the upper side toward the lower side. In the air blowoff passage portion, a number of spiral flow generating stators 50*a*, 50*a* . . . each having a specified angle of inclination (radial angle) in downward spiral direction are disposed together in all around direction at specified intervals.

Figure 18:
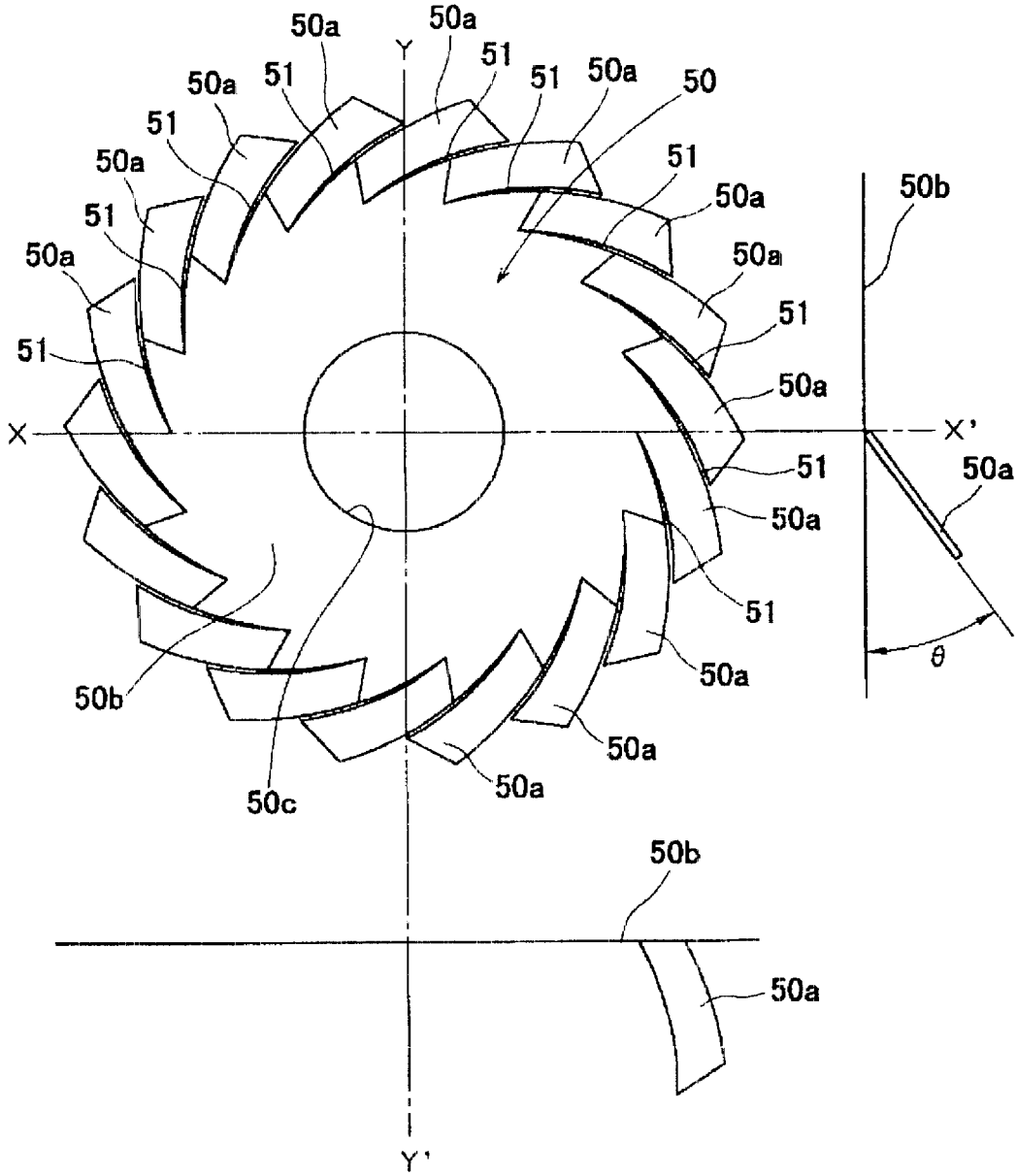
FIG. 18 is a schematic plane view showing constitution of a major portion of the same device.

As shown in FIG. 18 for example, the spiral flow generating stators 50*a*, 50*a* . . . are formed to be the ones in the shape of gradual circular arc in a radial direction having a radial angel of a specified ratio at a specified aspect ratio by the steps of providing slits 51, 51 . . . in parabolic direction on the outer peripheral edge of a round-shaped metallic flat plate 50 having an engage opening 50*c* to be engaged with the sleeve 40 in the center thereof, cutting out zonal slips in number corresponding to the number of spiral flow generating stators 50*a*, 50*a* . . . to be disposed, and bending each notched zonal slip in a specified position (position on a radial line) in the side of a main body portion 50*b* of the metallic flat plate 50 at a specified angle θ. The peripheral edge portion of the sleeve engage opening 50*c* in the inner peripheral side of the metallic flat plate main body portion 50*b* is fittingly placed on a flange 40*a* in the lower end of the sleeve 40 on the outer periphery of the exhaust duct 2 from the upper side, and fixed with screws 46, 46 . . . interposed after positioning is made through round-shaped long holes 43, 43 . . . , by which the portion of the spiral flow generating stators 50*a*, 50*a* . . . is adequately disposed inside the air blowoff passage of the air blowing port 3.

In this way, in the lower surface of the flange 40*a* in the lower end of the sleeve 40 supporting the flat plate main body portion 50*b* of the spiral flow generating stators 50*a*, 50*a* . . . , a top plate portion 10*b* of the doom-shaped exhaust hood 10 is integrally installed by removable installation means such as a slide engaging method so as to allow easy installation and removal from the lower side.

More particularly, for example, hook-shaped fitting slips 45, 45 . . . having a specified space in vertical direction are placed on the lower surface of the lower end flange 40*a* of the sleeve 40, while at the same time, square-shaped fitting holes 44, 44 . . . are provided on the top plate 10*b* side of the exhaust hood 10, where the fitting slips 45, 45 . . . are arbitrarily fitted to the fitting holes 44, 44 . . . and rotatively slid by a specified angle of rotation in circumferential direction from the fitting position, so that the edge portion of the fitting holes 44, 44 . . . is fitted into the space of the fitting slips 45, 45 . . . and engaged to overlap in the state of positioning, by which the exhaust hood 10 is installed, and fixed with screws 47, 47 . . . in the fitting position.

Further, in this embodiment, on the outer periphery of the opening edge lower end 10*d* of the exhaust hood 10, there is disposed an edge portion 14 for airflow control identical to the one in the embodiment 3 stated above.

According to this constitution, therefore, a blowoff airflow blown from the air blowing port 3 is attached to the edge portion 14 for airflow control, so that a direction of the blowoff airflow can be fixed without decreasing velocity of the blowoff airflow, by which a stable spiral flow can be generated.

Therefore, in the above constitution, when, for example, an air supply fan on the air supply duct 5 side and an exhaust fan on the exhaust duct 2 side are driven respectively, at first the outside air introduced to the air supply inlet 5*a* through the air supply duct 5 is blown by the blowoff pressure from the air supply fan in tangent direction in the air spiral supply space 4*c*. Then the air is effectively spiraled in the air spiral supply space 4*c* and regulated by, for example, airflow regulating holes 6*a*, 6*a* . . .on the current plate 6 to make a stable spiral flow with a uniform flow velocity, and thereafter supplied to the air blowing port 3 provided in between the inner peripheral surface of the lower end opening edge portion 4*d* in the air supply chamber 4 and the outer peripheral surface of a shoulder portion of the side wall 10*c* in the exhaust hood 10. Then, when passing through the air blowoff passage of the air blowing port 3, the air is imparted a larger spiral direction vector by the spiral flow generating stators 50*a*, 50*a* . . . to make a stronger and stable spiral airflow F1 with a uniform flow velocity in all around direction, and blown in inclined direction from the outer periphery of the exhaust hood 10 to the outer periphery of the heating and cooking appliance in a lower side local area.

As a result, due to the stable spiral blowoff airflow F1, there is created a reliable air curtain flow which encloses smoke and odor coming from the heating and cooking appliance so as to prevent them from diffusing to the surroundings, while at the same time, in a central axis direction inside the air curtain, there is created a tornado type spiral suction airflow F2, which has large suction force and ascends, due to the suction force of the exhaust fan, from the lower side to the upper side in the direction opposed to the airflow F1 toward the exhaust port 2*a* of the exhaust duct 2 which is provided in a cylindrical shape to extend lower to the vicinity of the opening plane of the air-collecting opening 10*a* of the exhaust hood 10.

Also at the same time, spiral airflow on the outer periphery of the central spiral airflow which is not directly sucked to the exhaust port 2*a* is collected inside the air-collecting opening 10*a* of the exhaust hood 10, which has sufficiently large opening area, and sucked and exhausted from the auxiliary exhaust ports 2*b*, 2*b* . . .

Consequently, the inner spiral airflow F2 enables reliable exhaust and cleaning of the contaminated air including smoke and odor in the heating and cooking appliance area enclosed by the air curtain composed of the spiral blowoff airflow F1.

As is clear from the above description, the tornado type air intake and blowing device in this embodiment comprises an exhaust hood 10 having an air-collecting opening 10*a* communicating with an exhaust duct 2; an air supply chamber 4 disposed to cover a top of the exhaust hood 10 to which air is supplied through an air supply inlet 5*a*; and air blowing port 3 spirally blowing the air supplied to the inside of the air supply chamber 4 from the outer periphery of the exhaust hood 10 diagonally downward, wherein opening plane of the air blowing port 3 and an opening plane of an air-collecting opening 10*a* of the exhaust hood 10 are placed vertically offset by a specified dimension L.

According to this constitution, therefore, it is possible to form the air-collecting opening 10*a* whose opening area is approximately equal to the opening area of the lower side opening plane of the air supply chamber 4, so that the outside diameter corresponding to necessary opening diameter of the exhaust port 10*a* is eventually sufficient for the air supply chamber 4, which enables to form a downsized device.

Further in this device, the air blowing port 3 is provided between a side wall 10*c* of the exhaust hood 10 and a lower end opening edge portion 4*d* of the air supply chamber 4 placed on an upper side of the exhaust hood 10.

More specifically, in the constitution of this device, against the exhaust hood 10 having the air-collecting opening 10*a* communicating with the exhaust duct 2 as stated above, the air supply chamber 4 to which air is supplied through the air supply inlet 5*a* is disposed offset by a specified dimension L in the upper direction so as to cover the upper portion of the exhaust hood 10. As a result, between the outer peripheral surface of the shoulder portion of the side wall 10*c* in the exhaust hood 10 and the lower end opening edge portion 4*d* of the air supply chamber 4 placed on the upper side of the exhaust hood 10, there is formed an adequate space for placing the air blowing port 3 which blows the air supplied into the air supply chamber 4 after whirling the same from the outer periphery of the exhaust hood 10 in inclined direction.

By utilizing this space, therefore, the above-stated air blowing port 3 can be formed effectively.

Further in this device, the air blowing port 3 has an edge portion 14 for airflow control disposed on a downstream side of the air blowing port 3 with a specified distance, and the edge portion 14 for airflow control is provided on an outer peripheral side of an opening edge lower end 10*d* of the air-collecting opening 10*a* of the exhaust hood 10.

According to this constitution, therefore, a blowoff direction of the blowoff airflow which is blown from the air blowing port 3 to the lower part of the outer periphery of the exhaust hood 10 is adequately controlled to a radial inner side by the edge portion 14 for airflow control provided on a specified adequate position on the downstream side, that is the outer peripheral side of the exhaust hood 10, by which a stable spiral flow can be generated.

Further, according to the tornado type air intake and blowing device as described above, in which the air introduced with a specified blowoff pressure by the air supply fan to the inside of the air spiral supply space 4*c* is blown as a spiral flow through the air blowing port 3 having a number of spiral flow generating stators 50*a*, 50*a* . . . disposed in circumferential direction at specified intervals, the spiral flow generating stators 50*a*, 50*a* . . . are formed by cutting the outer peripheral edge of a round-shaped metallic flat plate 50 into a necessary number of zonal strips and bending the cut zonal strips in a specified position at a specified angle.

According to the constitution, therefore, it is possible to collectively form a number of spiral flow generating stators 50*a*, 50*a* . . . only with two steps: a step of cutting the outer peripheral edge of the metallic flat plate 50 into zonal strips and a step of bending the zonal strips at a specified angle. Furthermore, in the time of assembling, it is enabled to install all the spiral flow generating stators 50*a*, 50*a* . . . in the air blowing port 3 through the main body portion 50*b* of the metallic flat plate 50 simultaneously with one step.

This increases installation accuracy of each of the spiral flow generating stators 50*a*, 50*a* . . . and also facilitates both the manufacturing process and assembling process thereof, by which product costs are significantly decreased.

Also in this device, an outside air introduction space to which outside air is introduced via the air supply inlet 5*a* of the air supply duct 5 is formed in the air spiral supply space 4*c* provided for spiraling the introduced air in advance, and the air supply inlet 5*a* of the air supply duct 5 is connected to the air spiral supply space 4*c* in tangent direction so as to spiral the introduced outside air.

According to the constitution, therefore, due to the functions of the air supply inlet 5*a* of the air supply duct 5 and the air spiral supply space 4*c*, the air supplied to the air blowing port 3 is preparatorily formed as a spiral flow, which betters the spiral flow generation effect of the spiral flow generating stators 50*a*, 50*a* . . .

As a result, a satisfactory air curtain flow with high closure property is formed.

In addition, the device is equipped with a current plate 6 having a number of airflow regulating holes 6*a*, 6*a* . . . to obtain even distribution of the flow velocity of the spiraled outside air.

According to the constitution, therefore, due to the functions of the air supply inlet 5*a*, the air spiral supply space 4*c*, and the current plate 6, the air supplied to the air blowing port 3 is preparatorily formed as a spiral flow with stable flow velocity distribution, which betters the spiral flow generation effect of the spiral flow generating stators 50*a*, 50*a* . . . , making the blowoff airflow more stable.

As a result, a satisfactory air curtain flow with higher closure property is formed.

Further in the device, the air spiral supply space 4*c* is formed inside an approximately conform blower chamber 4 and an exhaust port 2 open to outside having a doom-shaped exhaust hood 10 is provided inside the blower chamber 4 through the air spiral supply space 4*c*.

According to the constitution, therefore, the air introduced to the air spiral supply space 4*c* inside the approximately conform blower chamber 4 is blown as a spiral flow F1 through the air blowing port 3 to form an air curtain flow in the outer peripheral side of the exhaust hood 10.

On the other hand, inside of the spiral flow F1, there is formed a suction spiral vortex flow F2 which ascends like a tornado to the suction force for sucking air in exhaust direction through the exhaust port 2*a*, by which a satisfactory ventilating function is implemented.

Further in this device, the exhaust hood 10 is installed in the body of the air supply chamber 4 in a removable manner.

According to the constitution, therefore, it is possible to freely remove and clean the exhaust hood 10 that is most susceptible to being polluted as a ventilator.

As is clear from the above description, according to the tornado type air intake and blowing device in this embodiment, it is possible to provide a tornado type air intake and blowing device which has simple and low-cost structure and higher performance.

Therefore, if the device is, for example, applied to a local ventilating device, it is enabled to implement efficient ventilation of a specified local area with a reliable air curtain flow.

It is noted that the exhaust hood 10 having the edge portion 14 for airflow control in the above constitution is formed by, for example, molding with plastic or metal.

Embodiment 7

Figure 20:
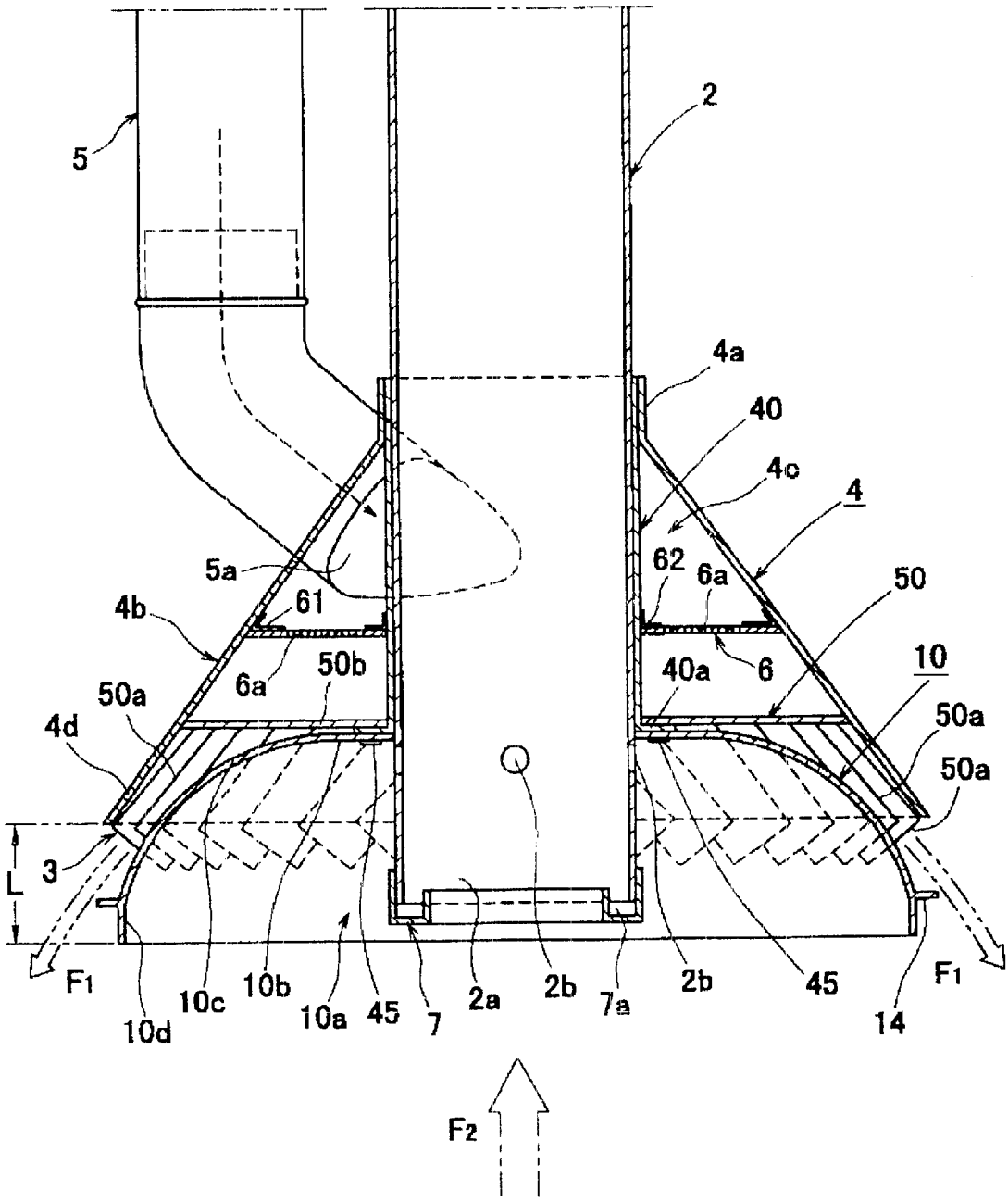
FIG. 20 is a cross sectional view showing constitution of a tornado type air intake and blowing device according to an embodiment 7 of the present invention.
Figure 21:
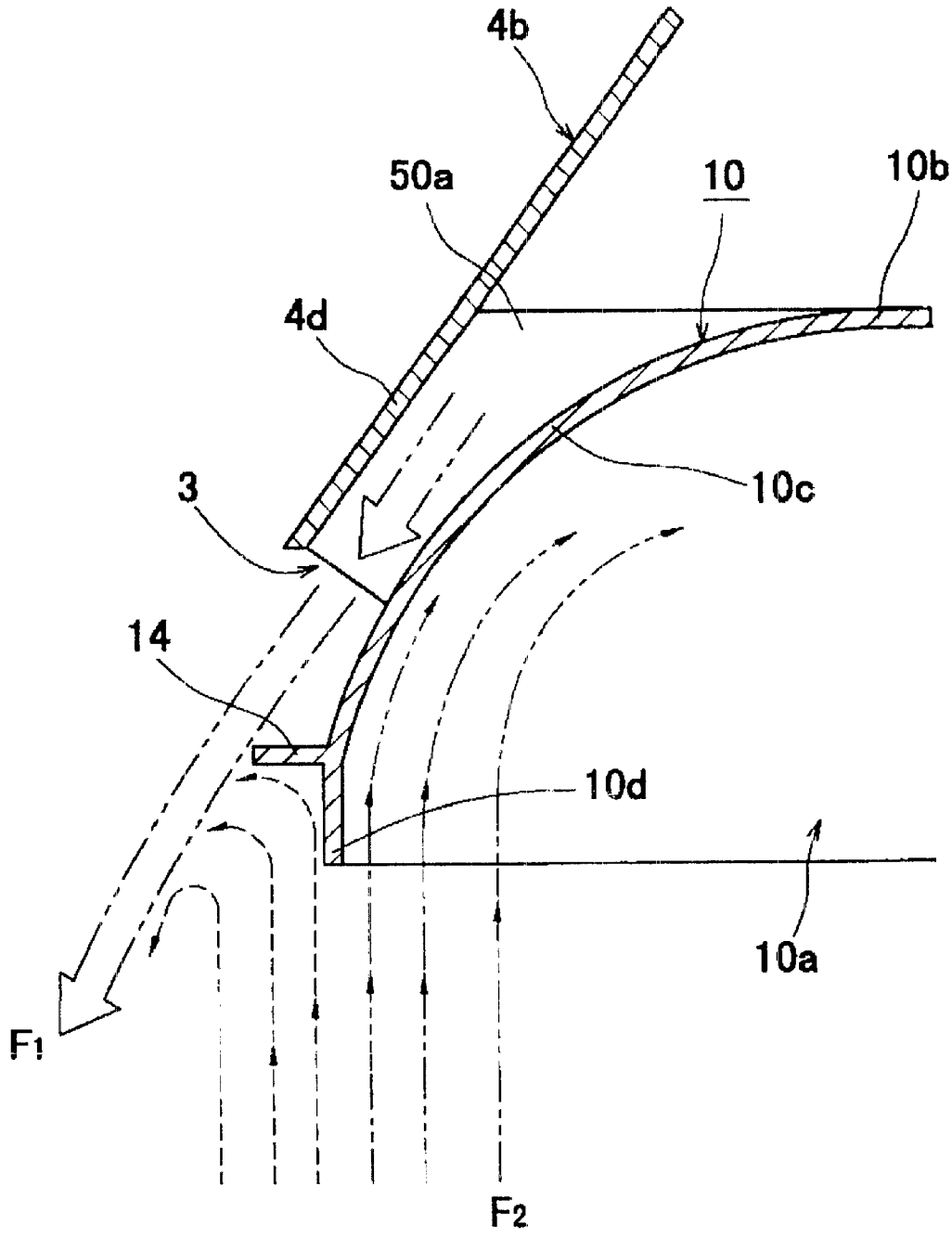
FIG. 21 is a schematic cross sectional view showing constitution of a major portion of the same device.

FIGS. 20 through 21 show the constitution of a tornado type air intake and blowing device according to the embodiment 7 of the present invention applied to a ventilator.

The tornado type air intake and blowing device of this embodiment has the constitution of the tornado type air intake and blowing device in the embodiment 6 as stated above, except that the opening edge lower end 10*d* of the air-collecting opening 10*a* of the exhaust hood 10 is extended and disposed lower than the edge portion 14 for airflow control. Other elements of constitution are identical.

Figure 19:
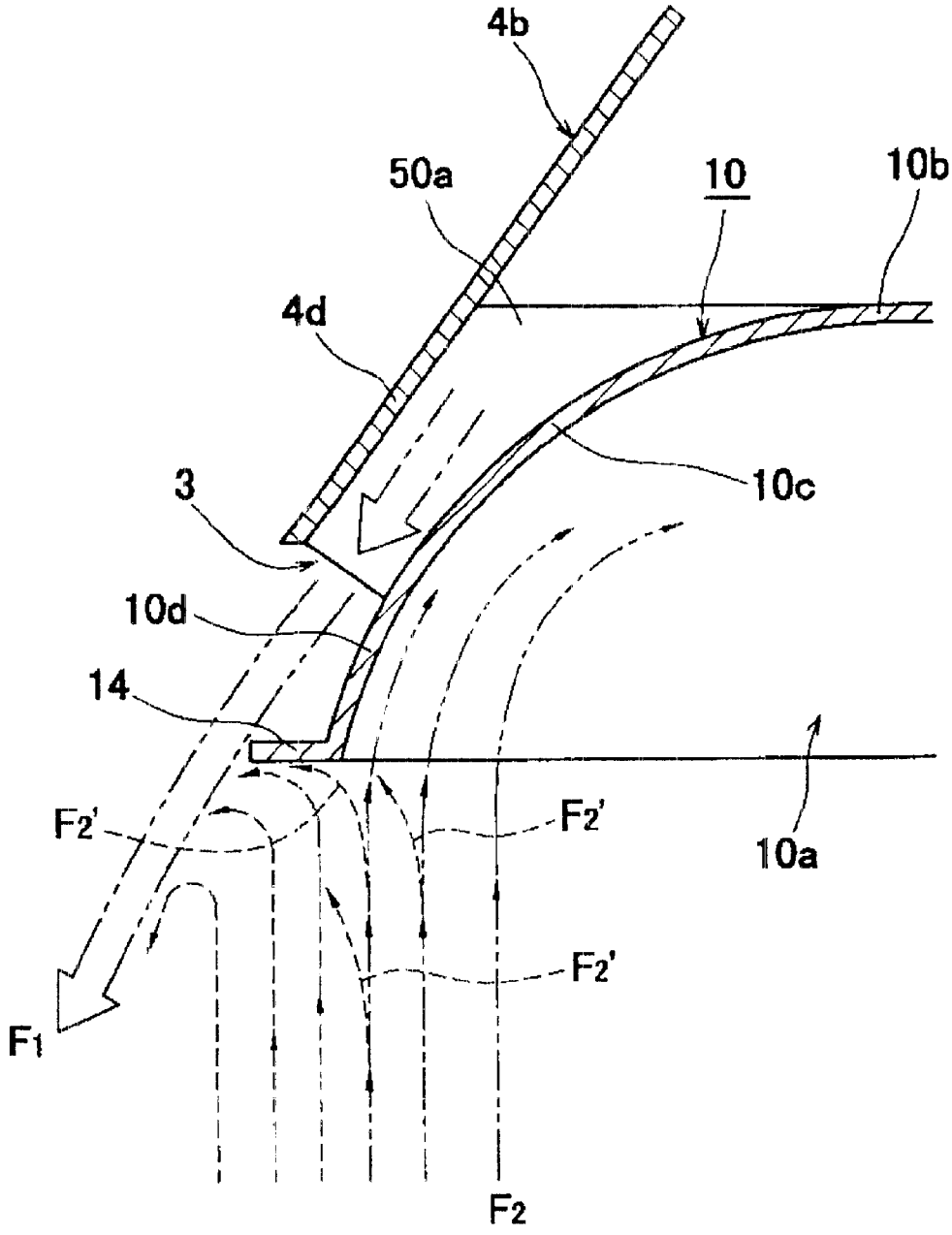
FIG. 19 is a schematic cross sectional view showing constitution of a major portion of the same device having several drawbacks.

As shown in the constitution of the above embodiment 6, where an edge portion 14 for airflow control is disposed on the outer peripheral side of the exhaust hood 10, if the edge portion 14 for airflow control is disposed to extend from the opening plane of the air-collecting opening 10*a* of the exhaust hood 10 to the radial outer side, an upward spiral airflow F2 on the outer peripheral side to be collected inside the exhaust hood 10 referred to as F2', F2' . . . in FIG. 19 for example is imparted a larger component of velocity to the radial outer side and so the airflow becomes prone to leak to the outside of the exhaust hood 10, by which the air collecting efficiency is decreased.

However, if the opening edge lower end 10*d* of the air-collecting opening 10*a* in the exhaust hood 10 is extended and disposed lower than the edge portion 14 for airflow control by a specified dimension as stated above, it is ensured that the outer:peripheral side upward spiral airflow F2 in exhaust direction can be intercepted and guided to the side of the air-collecting opening 10*a* in the exhaust hood 10 before it is imparted a larger component of velocity to the radial outer side, so that the air collecting efficiency in an exhaust direction can be increased.

It is noted that the exhaust hood 10 in the above constitution having an edge portion 14 for airflow control and an opening edge lower end 10*d* extended and disposed lower than the edge portion 14 for airflow control by a specified length is formed by methods such as integral molding including the edge portion 14 using plastic or molding the body of an exhaust hood 10 using a metal plate in a doom shape and thereafter welding a donut-shaped metallic edge portion 14 around the outer periphery of the exhaust hood 10 for integration.

Modified Embodiment

Figure 22:
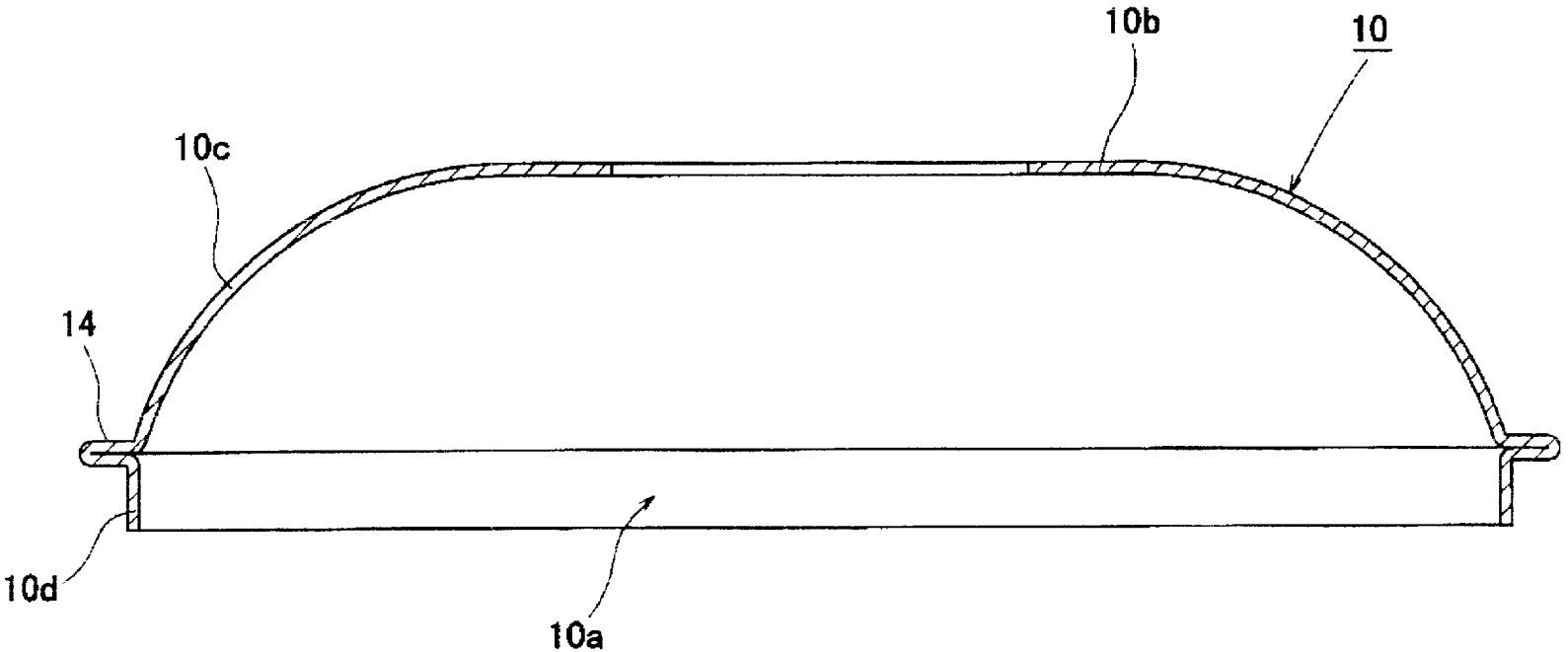
FIG. 22 is a cross sectional view showing constitution of a first modification of the tornado type air intake and blowing device according to the embodiment 7 of the present invention.
Figure 23:
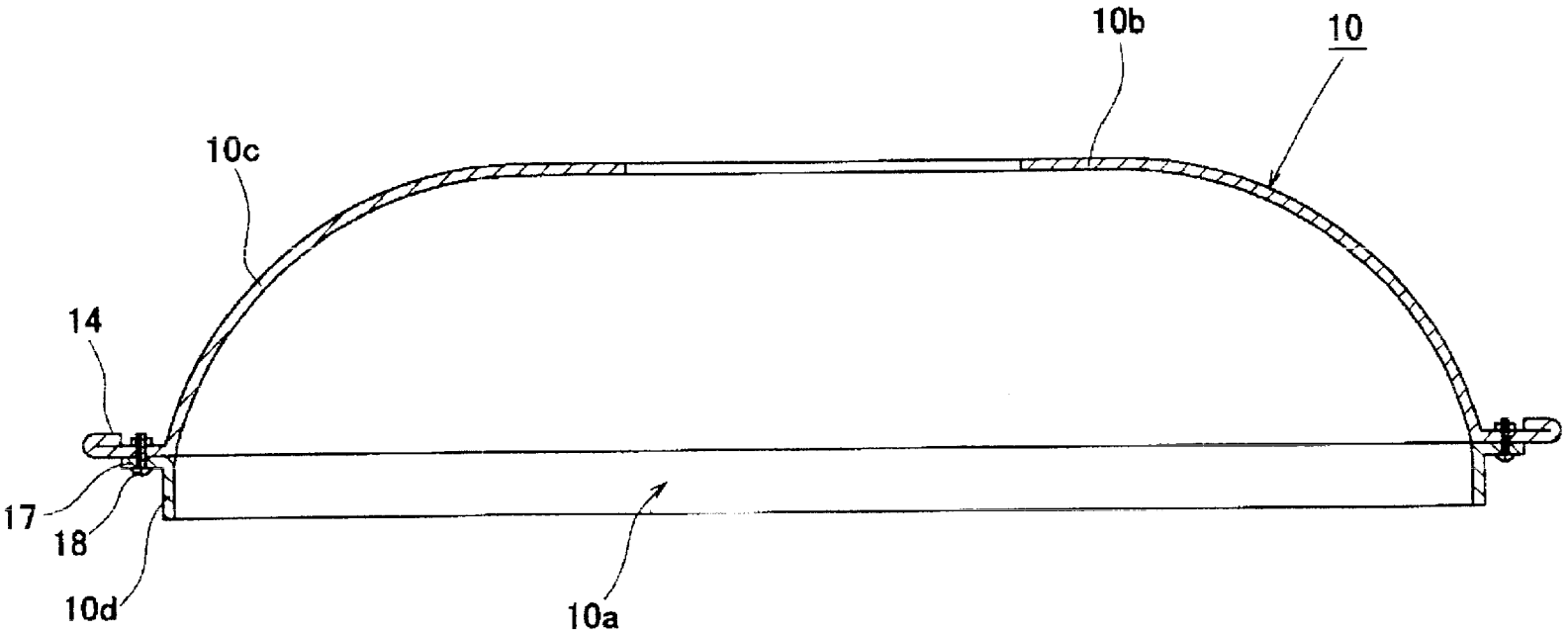
FIG. 23 is a cross sectional view showing constitution of a second modification of the same device.

The exhaust hood 10 in the above constitution having an edge portion 14 for airflow control and an opening edge lower end 10*d* extended and disposed lower than the edge portion 14 for airflow control by a specified length can also be formed by the methods shown in FIGS. 22 and 23 in addition to the methods shown above.

First of all, referring to the first modified embodiment of FIG. 22, where for example a doom-shaped body of the exhaust hood 10 is made of a metal plate or the like by using a desired mold, a specified position on the side wall of the opening edge portion thereof is, as shown in the drawing, curved in outer peripheral direction to integrally form an edge portion 14.

This enables to form the exhaust hood 10 with a single member and also in low cost as molding is easy.

Next, referring to the second modified embodiment of FIG. 23, an extensive sleeve having a corresponding installation edge portion 17 is added from the lower side to the edge portion 14 for airflow control on the body of the exhaust hood 10 structured according to the embodiment 6 stated above (see FIG. 15) by using, for example, a desired mold, and the edge portion 14 and installation edge portion 17 are integrated with screws 18, 18, . . . , by which the opening edge lower end 10*d* of the air-collecting opening 10*a* is extended and disposed lower than the edge portion 14 for airflow control.

In this case, the body of the exhaust hood 10 and the sleeve member for addition are made of either metal or plastic.

Embodiment 8

Figure 24:
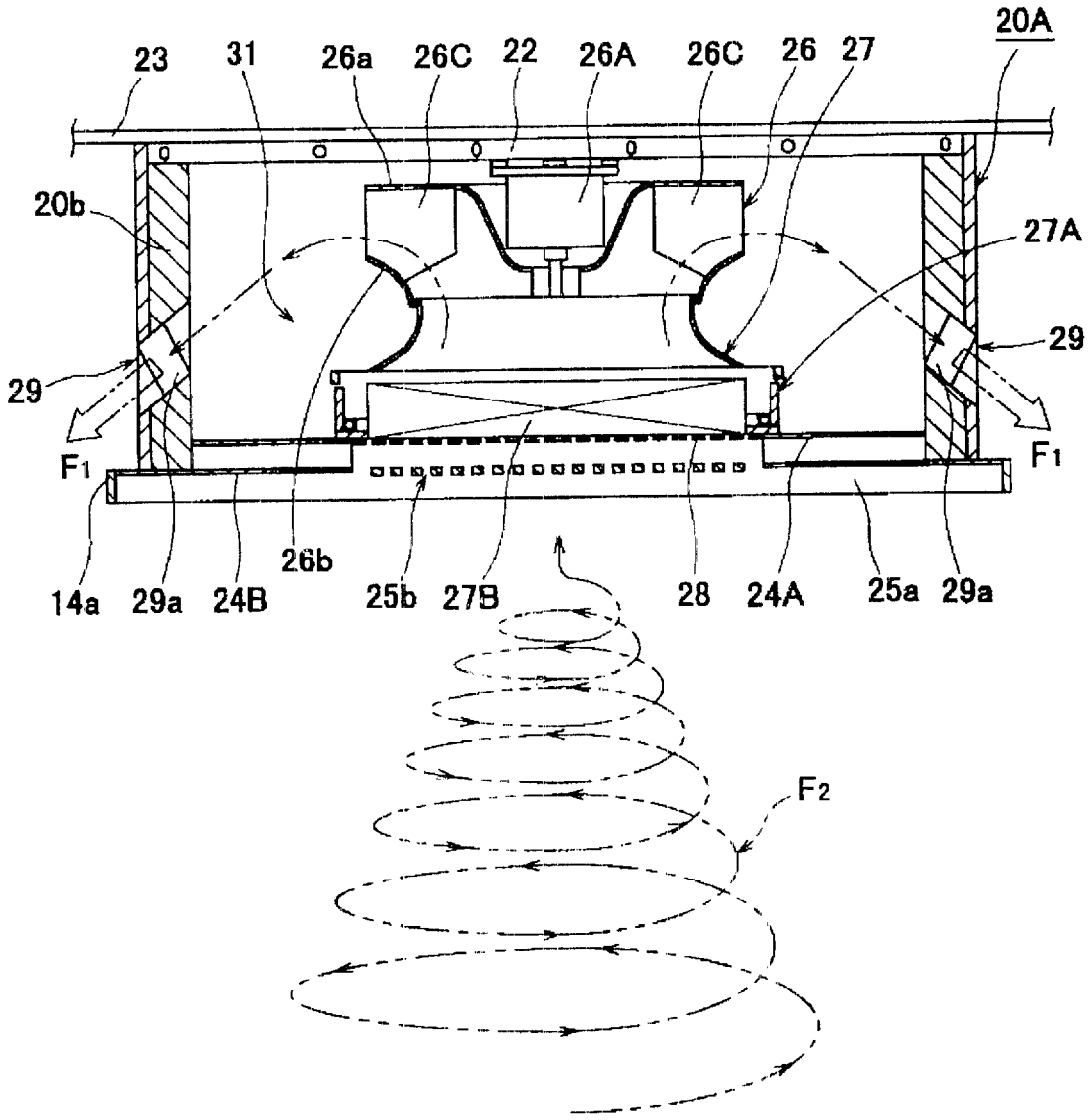
FIG. 24 is a cross sectional view showing constitution of a tornado type air intake and blowing device according to an embodiment 8 of the present invention.

Further, FIG. 24 shows the constitution and function of a tornado type air intake and blowing device according to the embodiment 8 of the present invention applied to a ceiling suspended air cleaner. This device is characterized by having an electric precipitator in the side of the air suction port.

In the drawing, firstly a numerical number 20A denotes a cassette-type body casing of a ceiling suspended air cleaner. A top plate 22 of the body casing 20A is integrally connected to a ceiling 23 and suspended therefrom as shown in the drawing.

A decorative panel 24A portion on the lower side of the body casing 20 is disposed slightly inner side, and beneath the decorative panel 24A, there is provided an intake hood 24B having a hat-shaped cross section and large opening plane whose diameter is larger than the width of the body casing 20A. In the central section thereof, there is formed an air suction port penetrating from the upper side to the lower side, where an air suction grill 25*b* and an air filter 28 are continuously provided, and upper inside thereof, a bell mouth 27 for a turbo fan 26 is continuously disposed through an electric precipitator 27A. It is noted that inside the electric precipitator 27A, there is provided a high-performance electrostatic electric dust collector element 27B incorporating an adsorption function to adsorb and remove fine dust such as cigarette smoke or pollen as well as offensive odor.

In addition, similar to each embodiment stated above, an air blowing port 29 having spiral flow generating stators 29*a*, 29*a* . . . is disposed on a side wall 20*b* of the body casing 20.

The air blowing port 29 forms an air blowoff passage inclined downward in outer peripheral direction at a specified angle of inclination, where the above-stated spiral flow generating stators 29*a*, 29*a* . . . are provided at an angle of inclination in spiral direction at specified intervals.

Inside the body casing 20 with the above-stated constitution, there is formed an air passage 31 in all-round direction leading from an air-collecting opening 25*a* having large area, and the air suction grill 25*b* of the intake hood 24B, through the air filter 28, the electric dust collector element 27B, the bell mouth 27, and the turbo fan 26 to the air blowing port 29. The turbo fan 26, which is located in the center of the air passage 31 and whose air suction side (shroud 26*b* side) is corresponding to the bell mouth 27, is suspended from the top plate 22 of the body casing 20 via a fan motor 26A. In the drawing, a numerical number 26*a* denotes a main shroud of the turbo fan 26, a numerical number 26*b* denotes the shroud, and numerical numbers 26*c*, 26*c* . . . denote moving vanes thereof.

When the turbo fan 26 is driven, therefore, indoor air in a specified local area under the air-collecting opening 25*a* and the air suction grill 25*b* is taken in from the air-collecting opening 25*a* and air suction grill 25*b*, and highly cleaned through the air filter 28 and the electric dust collector element 27B, and after blown by the turbo fan 26 in outer peripheral direction as shown in the drawing, the air is imparted a vector in a spiral direction by the spiral flow generating stators 29*a*, 29*a* . . . in the air blowoff passage area of the air blowing port 29 on the lower side of the body casing side wall 20*b*, and blown toward the flower below in inclined direction as a spiral airflow F1.

As a result, the spiral blowoff airflow F1 creates a tornado type spiral suction airflow F2 in a central axis direction inside the airflow F1, which has large suction force and ascends in the direction opposed to the airflow F1 due to the suction force of the turbo fan 26.

This enables reliable cleaning of the air in a specified local area enclosed with the air curtain composed of the spiral blowoff airflow F1.

A tornado type air intake and blowing device as an air conditioner according to the present embodiment comprises: an intake hood 24B for efficiently taking in air for air cleaning through an air-collecting opening 25*a* having large area and an air suction grill 25*b* without diffusing the air to surroundings; an air passage 31 provided upper inside of the body casing 20A so as to surround the intake hood 24B for blowing intake air through an air filter 28, an electric dust collector element 27B, and a turbo fan 26; and an air blowing port 29 having spiral flow generating stators 29*a*, 29*a* . . . which spirally blow the air cleaned through the air passage 31 from the outer periphery of the intake hood 24B diagonally downward, wherein the air blowing port 29 is first provided on a side wall 20*b* of a body casing 20 for the air conditioner.

According to this constitution, therefore, it is possible to form the air-collecting opening 25*a* and the air suction grill 25 as wide as possible over the lower side opening plane of the body casing 20 as illustrated, so that the outside diameter corresponding to the necessary opening diameters of the air-collecting opening 25*a* and the air suction grill 25*b*, and the diameter of the turbo fan 26 or the like is eventually sufficient for the body casing 20, which enables to form a downsized body of the air cleaner.

In the constitution of this embodiment, in the lower part of the air blowing port 29, the upper outer peripheral edge 14A of the intake hood 24B implements the same airflow control function as the edge portion 14 of the embodiment 3 stated above.

According to this constitution, therefore, a blowoff direction of the spiral airflow which is blown from the air blowing port 29 to the lower part of the outer periphery of the intake hood 24B is adequately controlled to a radial inner side by the edge portion 14A provided on a specified adequate position on the downstream side, that is the outer peripheral side of the intake hood 24B, by which a stable spiral flow can be generated.

Further in this case, the high-performance electric precipitator 27A is provided in addition to the air filter 28 according to the constitution of the device as stated above, which realizes high dust-collecting effect on sucked and blown air, and enables removal of fine dust such as cigarette smoke, pollen, and others, as well as offensive smells and odor such as cigarette smells, construction smells, and others.

Embodiment 9

Figure 25:
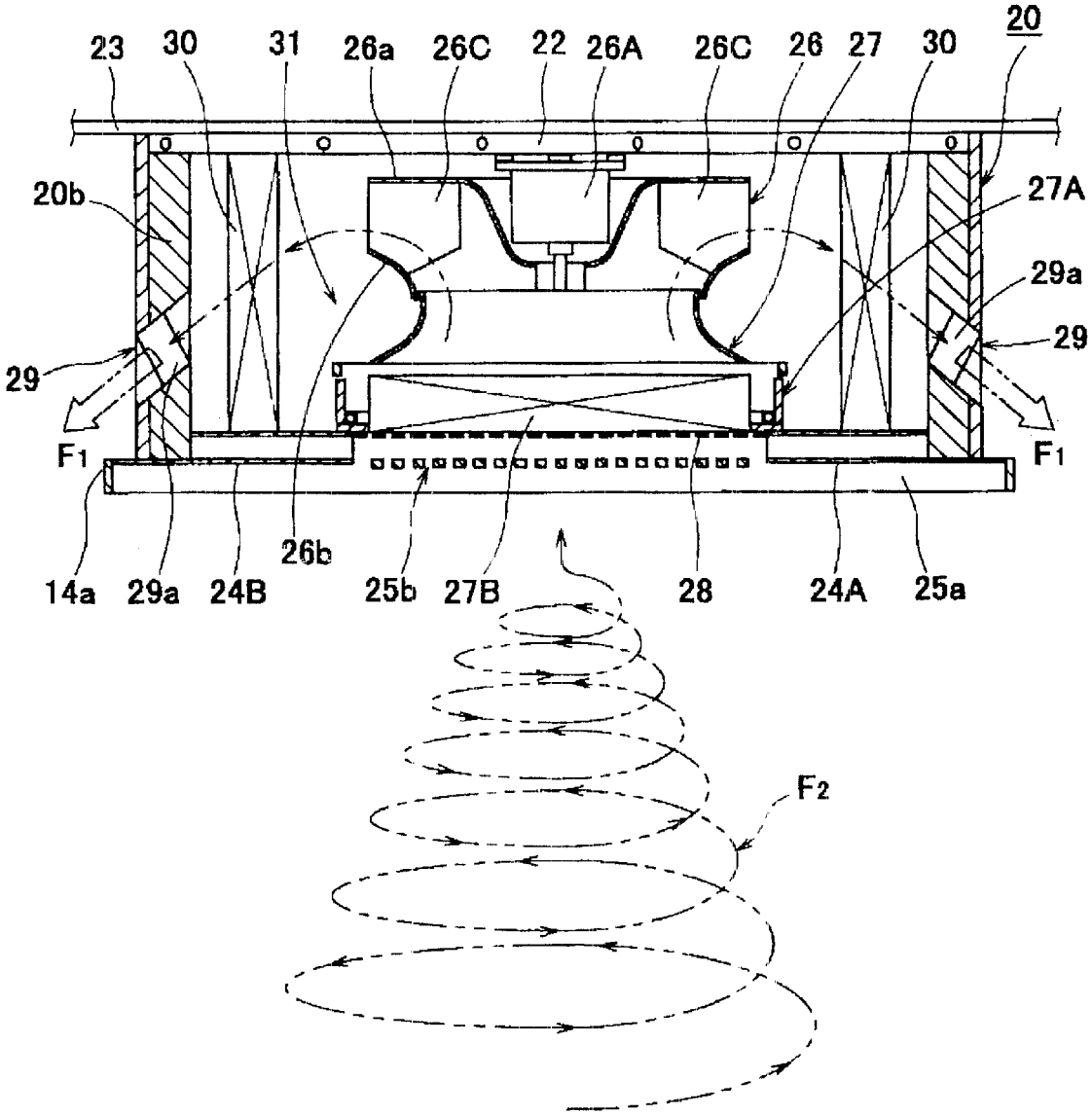
FIG. 25 is a cross sectional view showing constitution of a tornado type air intake and blowing device according to an embodiment 9 of the present invention.
Figure 26:
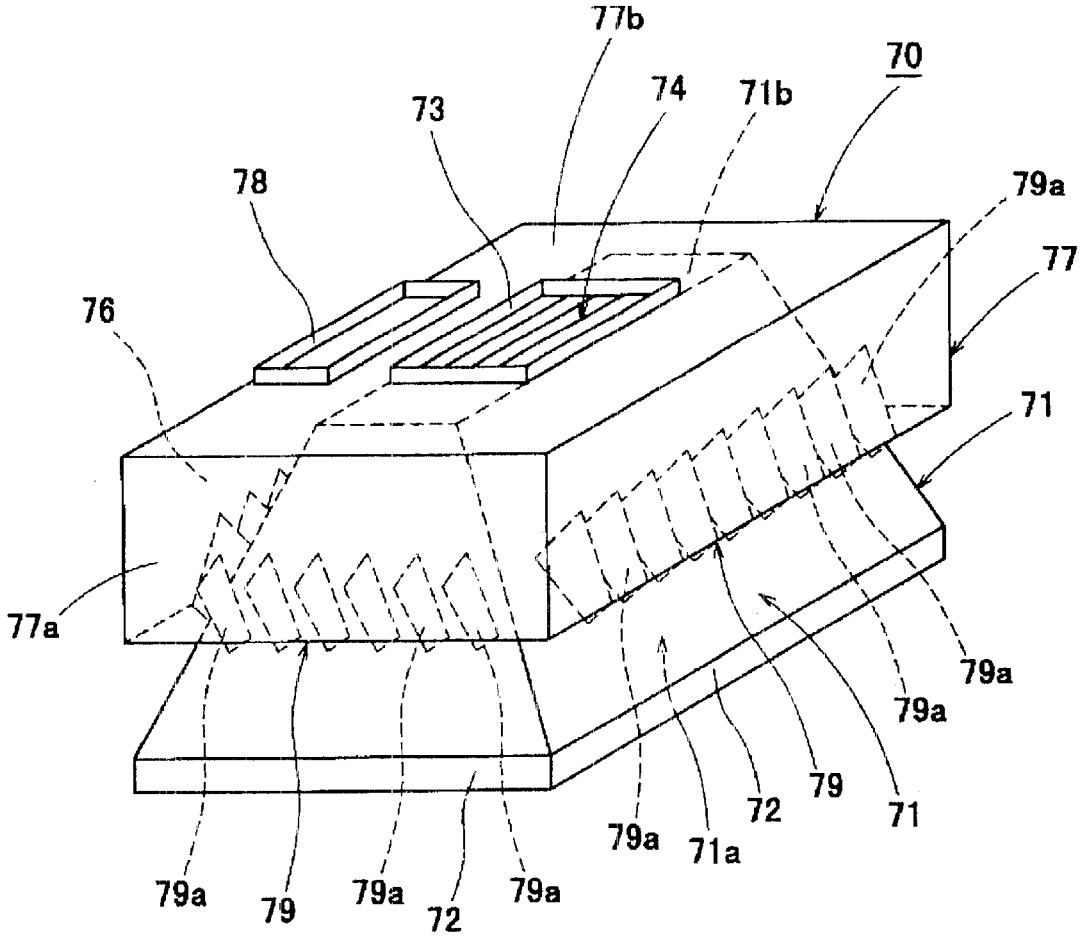
FIG. 26 is a perspective view showing constitution of a tornado type air intake and blowing device according to an embodiment 10 of the present invention.
Figure 27:
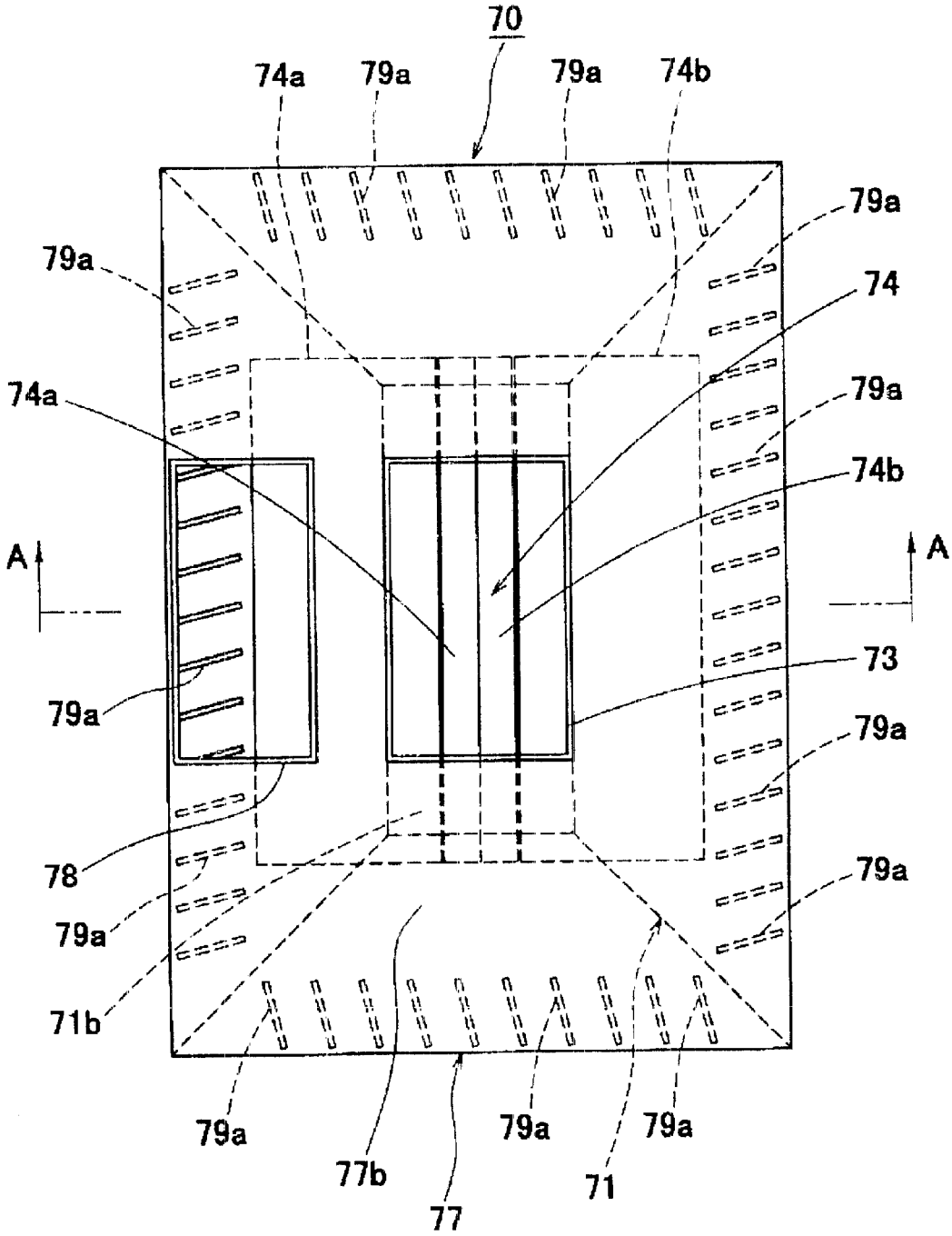
FIG. 27 is a plane view showing the constitution of the same device.
Figure 28:
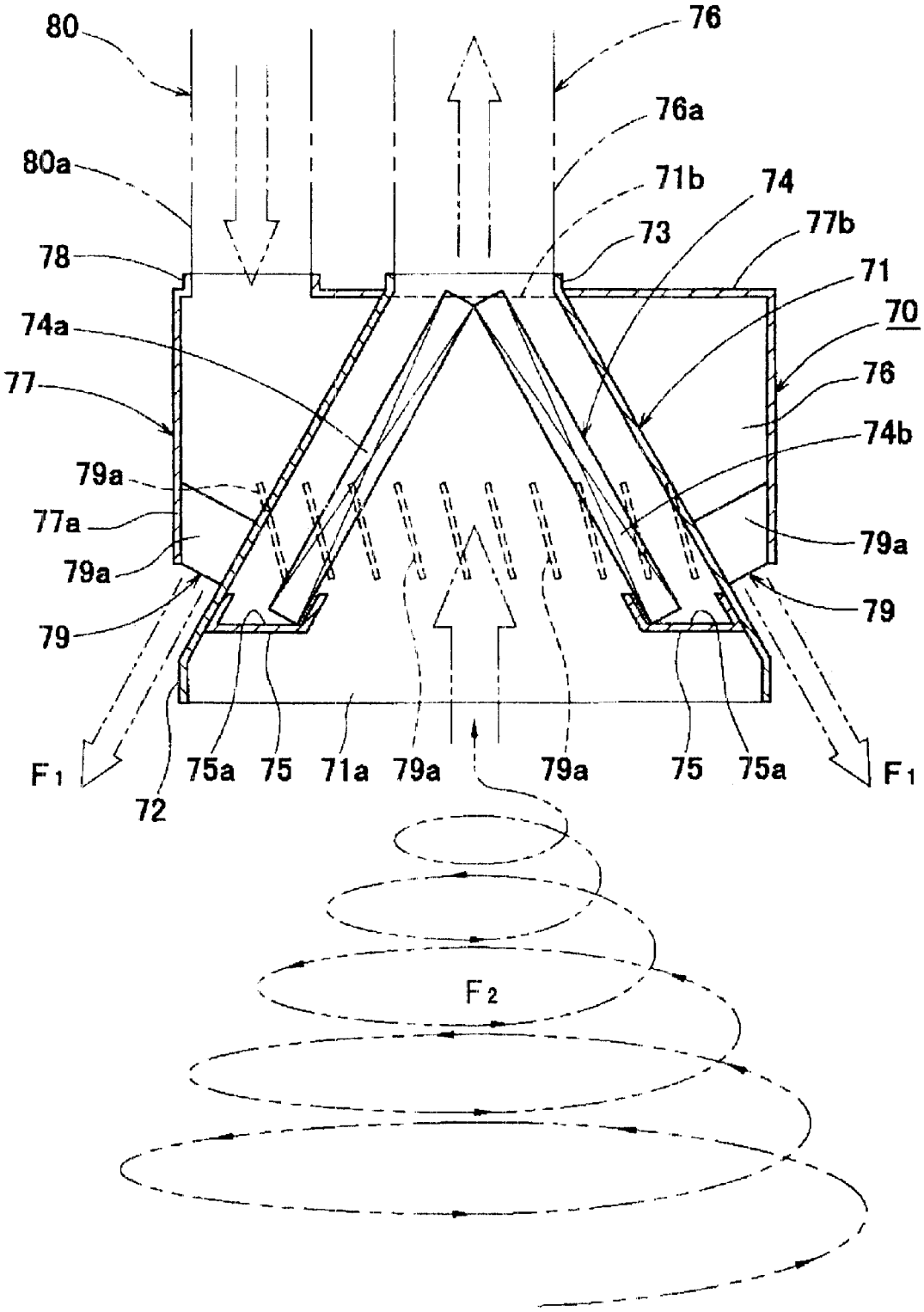
FIG. 28 is a cross sectional view (cross sectional view taken along line A—A of FIG. 27) showing the constitution of the same device.
Figure 29:
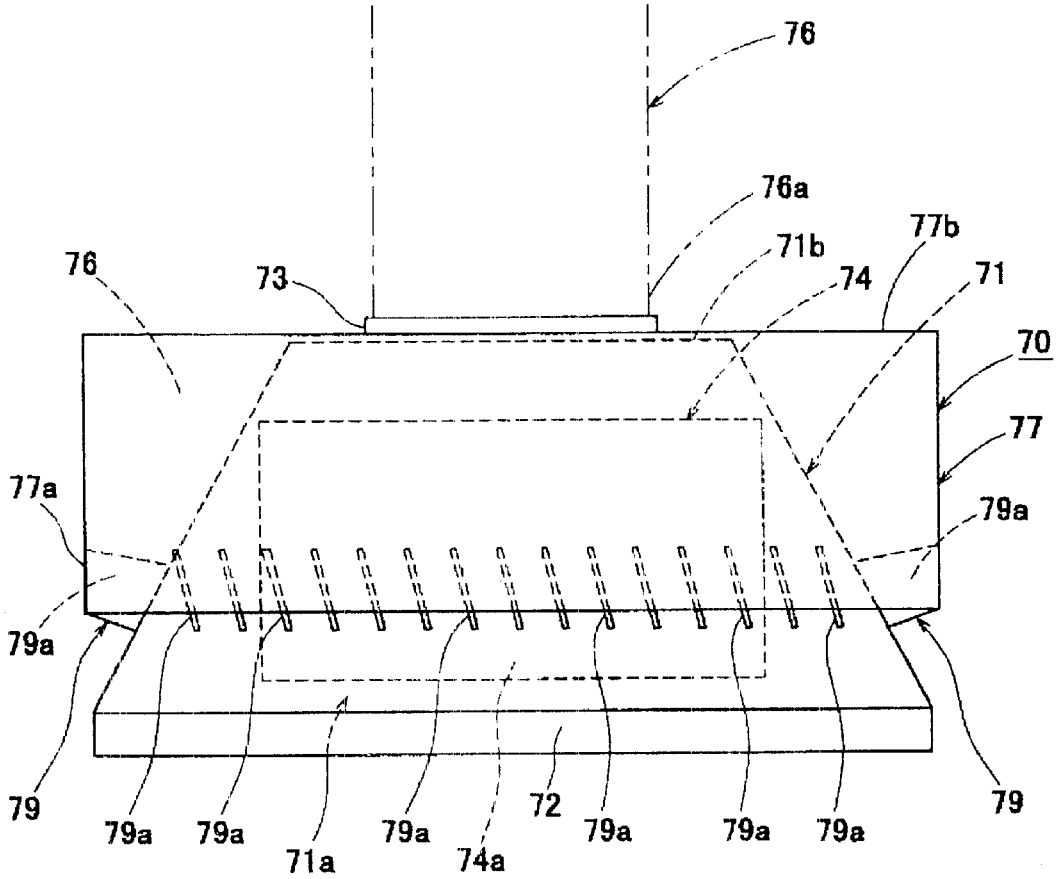
FIG. 29 is a front view showing the constitution of the same device.

Further, FIG. 25 shows the construction and function of a tornado type air intake and blowing device according to the embodiment 9 of the present invention applied to a ceiling suspended air conditioner. The device is characterized by having the same electric precipitator as shown above on the air suction port side thereof.

In the drawing, firstly a numerical number 20 denotes a cassette-type body casing of the ceiling suspended air cleaner. A top plate 22 of the body casing 20 is integrally connected to a ceiling 23 and suspended therefrom as shown in the drawing.

A decorative panel 24A portion on the lower side of the body casing 20 is disposed slightly inner side, and beneath the decorative panel 24A, there is provided an intake hood 24B having a hat-shaped cross section and large opening plane whose diameter is larger than the width of the body casing 20. In the central section thereof, there is formed an air suction port penetrating from the upper side to the lower side, where an air suction grill 25*b* and an air filter 28 are continuously provided, and upper inside thereof, a bell mouth 27 for a turbo fan 26 is continuously disposed through an electric precipitator 27A. It is noted that inside the electric precipitator 27A, there is provided a high-performance electrostatic electric dust collector element 27B incorporating an adsorption function to adsorb and remove fine dust such as cigarette smoke or pollen as well as offensive odor.

In addition, similar to each embodiment stated above, an air blowing port 29 having spiral flow generating stators 29*a*, 29*a* . . . is disposed on a side wall 20*b* of the body casing 20.

The air blowing port 29 forms an air blowoff passage inclined downward in outer peripheral direction at a specified angle of inclination, where the above-stated spiral flow generating stators 29*a*, 29*a* . . . are provided at an angle of inclination in spiral direction at specified intervals.

Inside the body casing 20 with the above-stated constitution, there is formed an air passage 31 in all-round direction leading from an air-collecting opening 25*a* having large area and the air suction grill 25*b* of the intake hood 24B, through the air filter 28, the electric dust collector element 27B, the bell mouth 27, the turbo fan 26, and an heat exchanger 30 to the air blowing port 29. The turbo fan 26, which is located in the center of the air passage 31 and whose air suction side (shroud 26*b* side) is corresponding to the bell mouth 27, is suspended from the top plate 22 of the body casing 20 via a fan motor 26A. In the drawing, a numerical number 26*a* denotes a main shroud of the turbo fan 26, a numerical number 26*b* denotes the shroud, and numerical numbers 26*c*, 26*c* . . . denote moving vanes thereof. Around the turbo fan 26, there is provided a heat exchanger 30 for air conditioning.

When the turbo fan 26 is driven, therefore, indoor air in a specified local area under the air-collecting opening 25*a* and the air suction grill 25*b* is taken in from the air-collecting opening 25*a* and the air suction grill 25*b*, and highly cleaned through the air filter 28 and the electric dust collector element 27B and air-conditioned through the heat exchanger 30 for air conditioning, and after blown by the turbo fan 26 in outer peripheral direction as shown in the drawing, the air is imparted a vector in a spiral direction by the spiral flow generating stators 29*a*, 29*a* . . . in the air blowoff passage area of the air blowing port 29 on the lower side of the body casing side wall 20*b*, and blown toward the flower below in inclined direction as a spiral airflow F1.

As a result, the spiral blowoff airflow F1 creates a tornado type spiral suction airflow F2 in a central axis direction inside the airflow F1, which has large suction force and ascends in the direction opposed to the airflow F1 due to the suction force of the turbo fan 26.

This enables reliable cleaning of the air in a specified local area enclosed with the air curtain composed of the spiral blowoff airflow F1.

A tornado type air intake and blowing device as an air conditioner according to the present embodiment comprises: an intake hood 24B for efficiently taking in air for air cleaning through an air-collecting opening 25*a* having large area and an air suction grill 25*b* without diffusing the air to surroundings; an air passage 31 provided upper inside of the body casing 20A so as to surround the intake hood 24B for blowing intake air through an air filter 28, an electric dust collector element 27B, a turbo fan 26, and a heat exchanger 30; and air blowing port 29 having spiral flow generating stators 29*a*, 29*a* . . . which spirally blow the air cleaned through the air passage 31 from the outer periphery of the intake hood 24B diagonally downward, wherein the air blowing port 29 is first provided on a side wall 20*b* of a body casing 20 for the air conditioner.

According to this constitution, therefore, it is possible to form the air-collecting opening 25*a* and the air suction grill 25 as wide as possible over the lower side opening plane of the body casing 20 as illustrated, so that the outside diameter corresponding to the necessary opening diameters of the air-collecting opening 25*a* and the air suction grill 25*b*, and the diameter of the turbo fan 26 or the like is eventually sufficient for the body casing 20, which enables to form a downsized body of the air cleaner.

In the constitution of this embodiment, in the lower part of the air blowing port 29, the upper outer peripheral edge 14A of the intake hood 24B implements the same airflow control function as the edge portion 14 of the embodiment 3 stated above.

According to this constitution, therefore, a blowoff direction of the spiral airflow which is blown from the air blowing port 29 to the lower part of the outer periphery of the intake hood 24B is adequately controlled to a radial inner side by the edge portion 14A provided on a specified adequate position on the downstream side, that is the outer peripheral side of the intake hood 24B, by which a stable spiral flow can be generated.

Further in this case, the high-performance electric precipitator 27A is provided in addition to the air filter 28 according to the constitution of the device as stated above, which realizes high dust-collecting effect on sucked and blown air, and enables removal of fine dust such as cigarette smoke, pollen, and others, as well as offensive smells and odor such as cigarette smells, construction smells, and others.

Embodiment 10

FIGS. 26 through 29 show the constitution of a tornado type air intake and blowing device according to the embodiment 10 of the present invention applied to a ventilator.

This tornado type air intake and blowing device is as one example, installed on a specified local area, like the upper area of a heating and cooking appliances such as gas range tables in general household kitchens or business-use kitchens for restaurants and the like. With this device, an outer periphery of the heating and cooking appliance are enclosed with an spiral flow F1 from the upper side to the lower side produced by the outside air introduced from outdoors like an air curtain, and at the same time, a tornado type spiral vortex flow F2 is generated in upward direction within the air curtain-like spiral flow F1 with a suction negative pressure in an exhaust direction worked on the center portion inside the air curtain-like spiral flow F1. By using this upward spiral vortex flow, smoke, odor or the like generated by the heating and cooking apparatuses or the like in the specified local area can be effectively sucked and exhausted outdoor.

In the drawings, a numerical number 77 denotes, for example, an approximately hexahedron-shaped air supply chamber having open lower plane provided on the upper section of a source of contaminated air containing odor and smoke. In lower part inside the air supply chamber 77, a truncated pyramid-shaped intake hood 71 whose diameter increases from the upper side to the lower side is provided in exhaust direction with a specified space from a side wall 77*a* and extended to a position lower than the lower edge opening plane of the air supply chamber 77 by a specified dimension, with which the intake hood 71 is integrated (offset disposition). Accordingly, between the air supply chamber 77 and the intake hood 71 inside thereof, there is formed an air supply space 76 whose passage diameter is gradually enlarged downward, for guiding the outside air taken in from an air supply duct 80 described later through an outside air inlet 78 toward air blowing port 29. Inside the air supply space 76, there is provided as needed a current plate (illustration omitted) positioned on the outer periphery of the intake hood 71 to regulate the air supplied as described above. This current plate is made of, for example, a punching plate.

In addition, an outside air inlet 78 to be connected to an introduction edge portion 80*a* of the air supply duct 80 is disposed on one side of a top plate portion 77*b* of the air supply chamber 77 for introducing the outside air supplied through the air supply duct 80, and also an exhaust duct connection port 73 is disposed in the center of the air supply chamber 77 and a top plate portion 71*b* of the intake hood 71 penetrating through the top plate portion 77*b* of the air supply chamber 77. The outside air inlet 78 and the exhaust duct connection port 73 are each communicating with the air supply duct 80 and an exhaust duct 76, where an outside air intake terminal and an inside air exhaust terminal are each extensively provided outdoors. The extensively provided outdoor terminals of the air supply duct 80 and the exhaust duct 76, which are not illustrated, are each equipped with an air supply fan and an exhaust fan made up of, for example, a sirocco fan, and the driving force of each fan implements corresponding air supply function and exhaust function, respectively.

In the case of this embodiment, an air blowing port 79 is, for example, located on the outer peripheral surface of the side plate of the intake hood 71 inside the lower side opening plane (lower end opening plane of the side wall 77*a*) of the air supply chamber 77 and open continuously in all around direction in the shape of a square-ring, and formed slantwise at a specified angle of inclination from the upper position to the outer lower position. In air blowoff passage section thereof, spiral flow generating stators 79*a*, 79*a* . . . having a specified angle of inclination in spiral direction downward are disposed together at a specified interval in all around direction.

In addition, a lower edge portion 72 of the intake hood 71 is bent straightly downward by a specified dimension so as to be lower than the outer peripheral edge of the air blowing port 79, and forms an approximately regular cylindrical part, inside of which an air-collecting opening 71*a* having large area is formed. On the left and the right sides of the upper position of the air-collecting opening 71*a*, grease filters 74*a* and 74*b* are disposed in pairs through oil receivers 75, 75 in an inverse V-shape open to lower side as air cleaning means 74. An oil mist component in the indoor air sucked through the air-collecting opening 71*a* and led to the exhaust duct 76 direction is collected and removed by the grease filters 74*a* and 74*b* . In collecting the oil mist component, the oil running down from the grease filters 74*a* and 74*b* is kept in an oil reservoir 75*a* inside an oil receiver 75 and removed through a desired oil removing route.

Therefore, in the above constitution, if, for example, an outside air blowoff fan on the air supply duct 80 side and an exhaust fan on the exhaust duct 76 side are driven in the state of, for example, FIGS. 26 through 29, at first the outside air introduced to the outside air inlet 78 through the air supply duct 80 is blown by the blowoff pressure from the outside air blowoff fan to the inside of the air supply space 76. Then the air is supplied from the air supply space 76 as an airflow having more uniform flow velocity to the air blowing ports 79, 79, 79, and 79 disposed on the outer periphery of the side plate portion (lateral portion of the device) of the intake hood 71 inside the lower opening plane of the air supply chamber 77. Then, when passing through the air blowoff passages of the air blowing ports 79, 79, 79, and 79, the air is imparted a spiral direction vector by the spiral flow generating stators 79*a*, 79*a* . . . to make a strong spiral airflow F1, and blown in an inclined direction to the outer periphery of the heating and cooking appliance in a lower side local area.

As a result, due to the spiral blowoff airflow F1, there is created an air curtain which encloses smoke and odor coming from the heating and cooking appliance so as to prevent them from diffusing to the surroundings, while at the same time, in a central axis direction inside the air curtain, there is created a tornado type spiral suction airflow F2 which has large suction force and ascends, due to the suction force of the exhaust fan, from the lower side to the upper side in the direction opposed to the airflow F1 toward the exhaust port 1*a* inside the exhaust hood 1 on the exhaust duct 2 side.

This enables reliable exhaust and cleaning of the contaminated air including smoke and odor in the heating and cooking appliance area enclosed by the air curtain composed of the spiral blowoff airflow F1.

The oil mist component in the indoor air led to the exhaust duct 76 direction through the air-collecting opening 71*a* as described above is ensured to be collected and removed by the grease filters 74*a* and 74*b* (air cleaning means 74) disposed in pairs in an inverse V shape. Therefore, the exhaust duct 76 is not blocked by the oil mist component, which facilitates maintenance operation.

Further in this embodiment, by using space between the inner peripheral surface of the side wall of the lower end opening portion of the air supply chamber 77 and the outer peripheral surface of the side plate portion of the intake hood 71 formed by offsetting the lower end opening planes of the air supply chamber 77 and the intake hood 71 in vertical direction by a specified dimension, the air blowing ports 79 are continuously opened annularly in all around direction with a specified passage length in blowoff direction and formed slantwise at a specified angle of inclination from the upper side toward the lower side.

According to this constitution, therefore, it is possible to form the air-collecting opening 71*a* whose opening area is approximately equal to the opening area of the lower side opening plane of the air supply chamber 77, so that the outside diameter corresponding to necessary opening diameter of the air-collecting opening 71*a* is eventually sufficient for the air supply chamber 77, which enables to form a downsized device.

Figure 30:
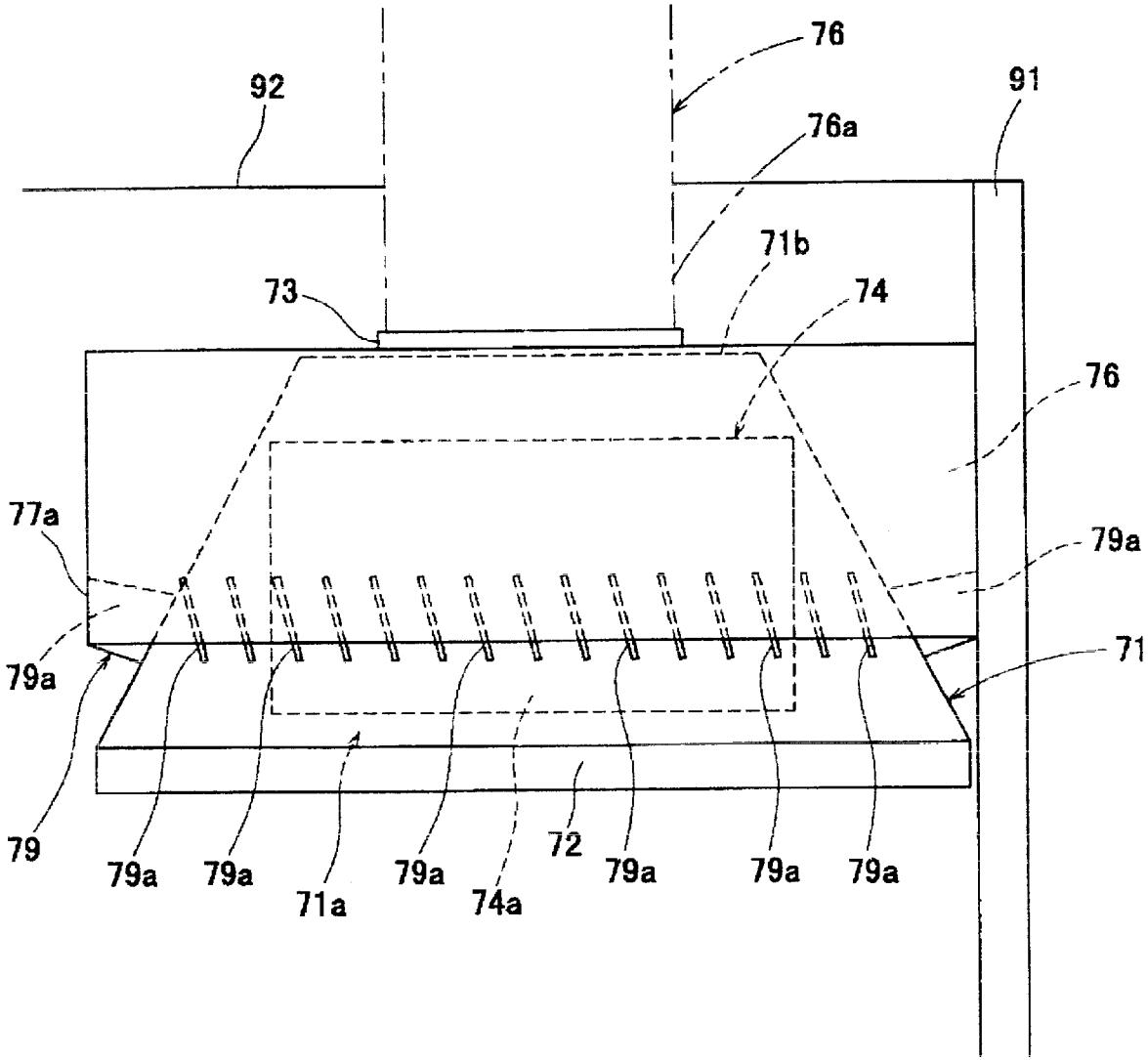
FIG. 30 is a front view showing installation configuration of the same device according to FIG. 29.
Figure 31:
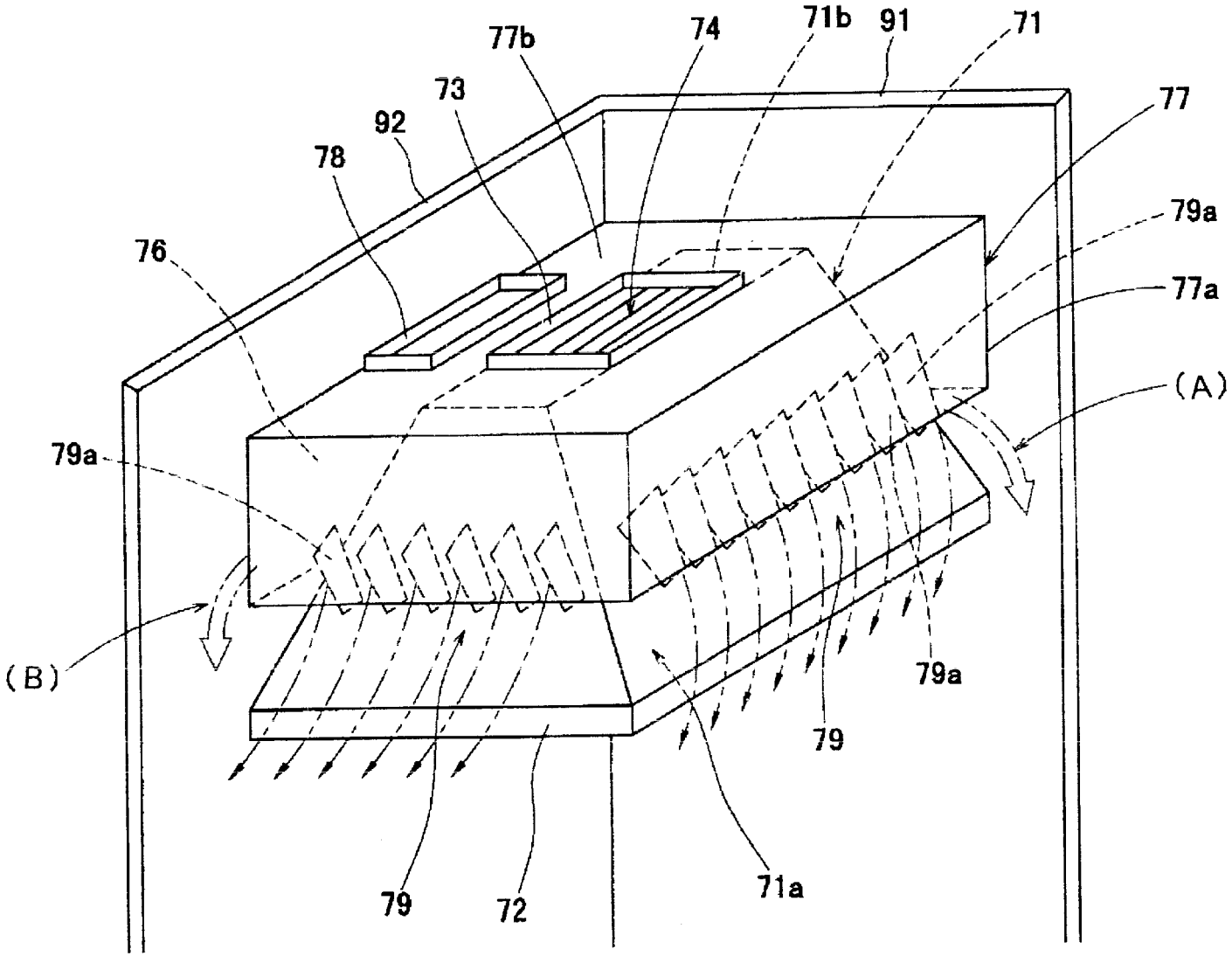
FIG. 31 is a perspective view showing the installation configuration shown in FIG. 30.
Figure 32:
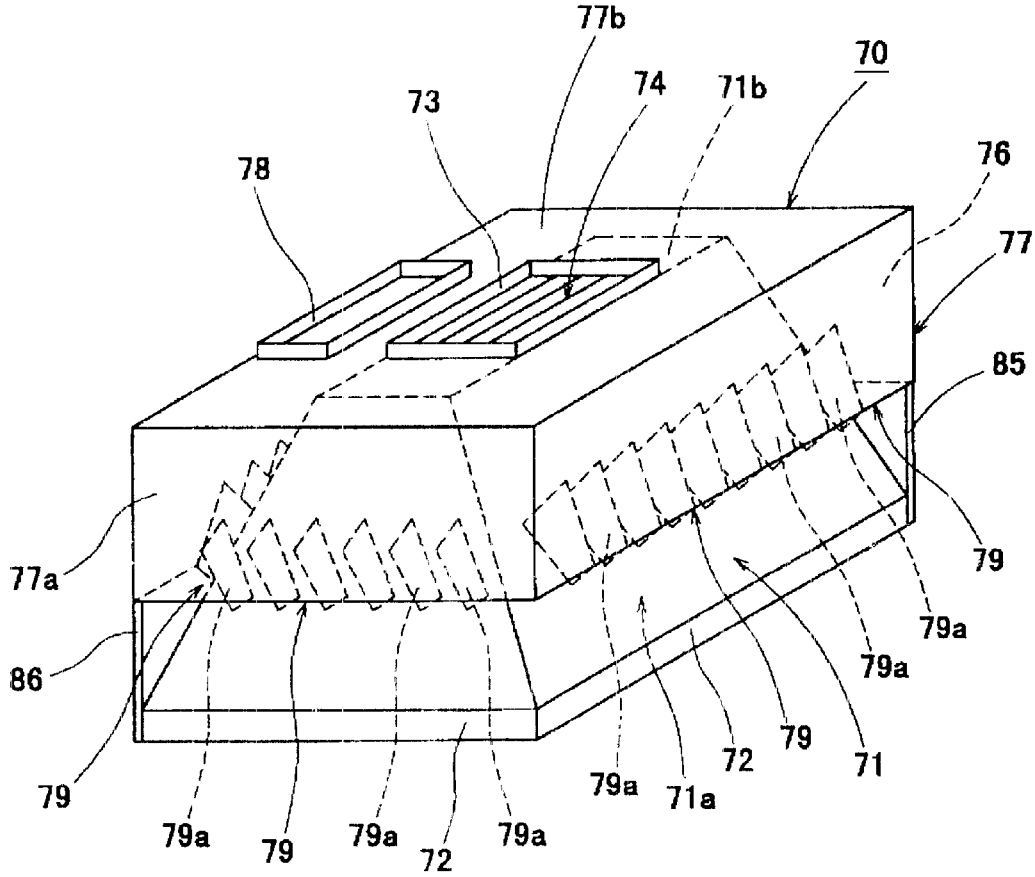
FIG. 32 is a perspective view showing constitution of a tornado type air intake and blowing device according to an embodiment 11 of the present invention.
Figure 33:
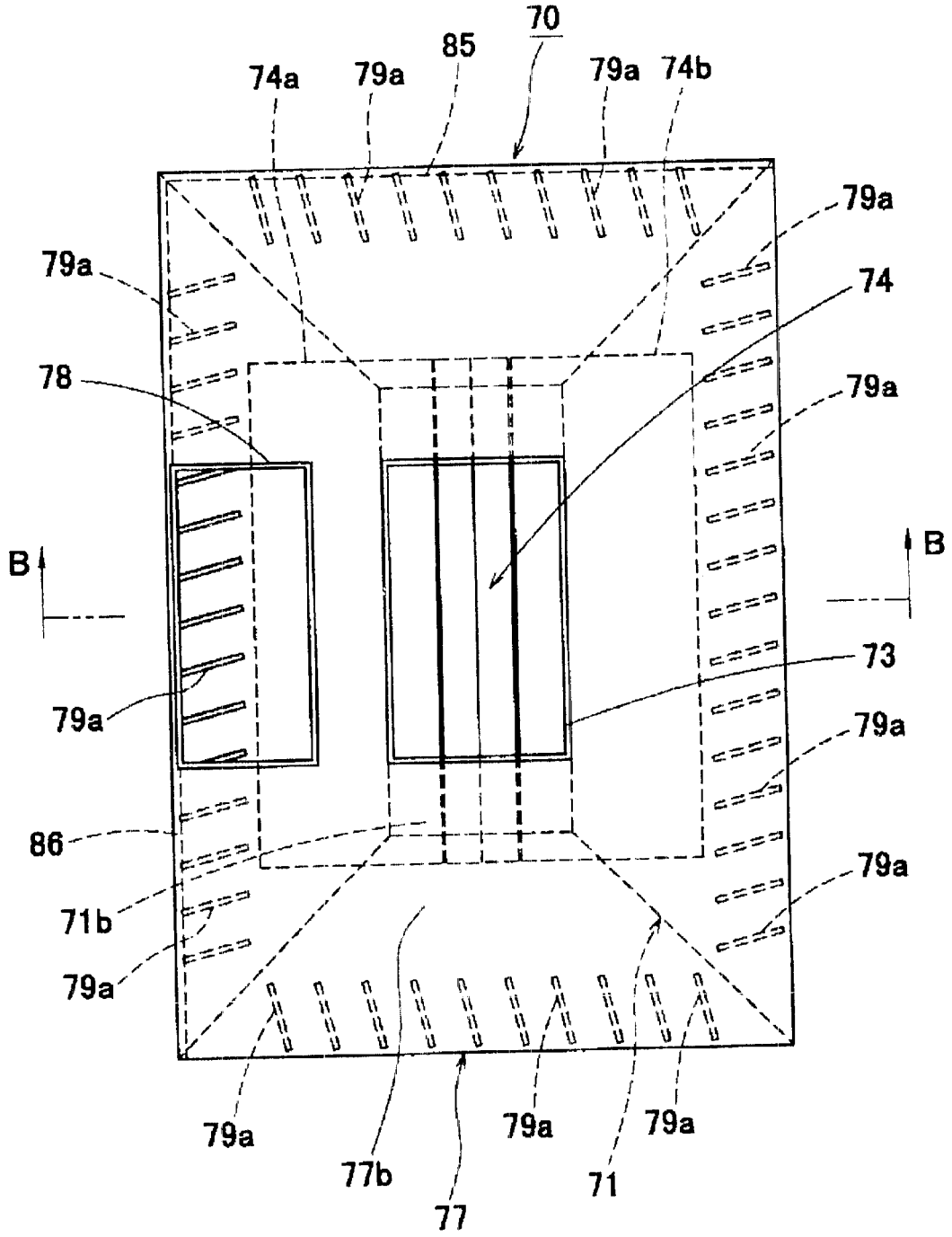
FIG. 33 is a plane view showing the constitution of the same device.
Figure 34:
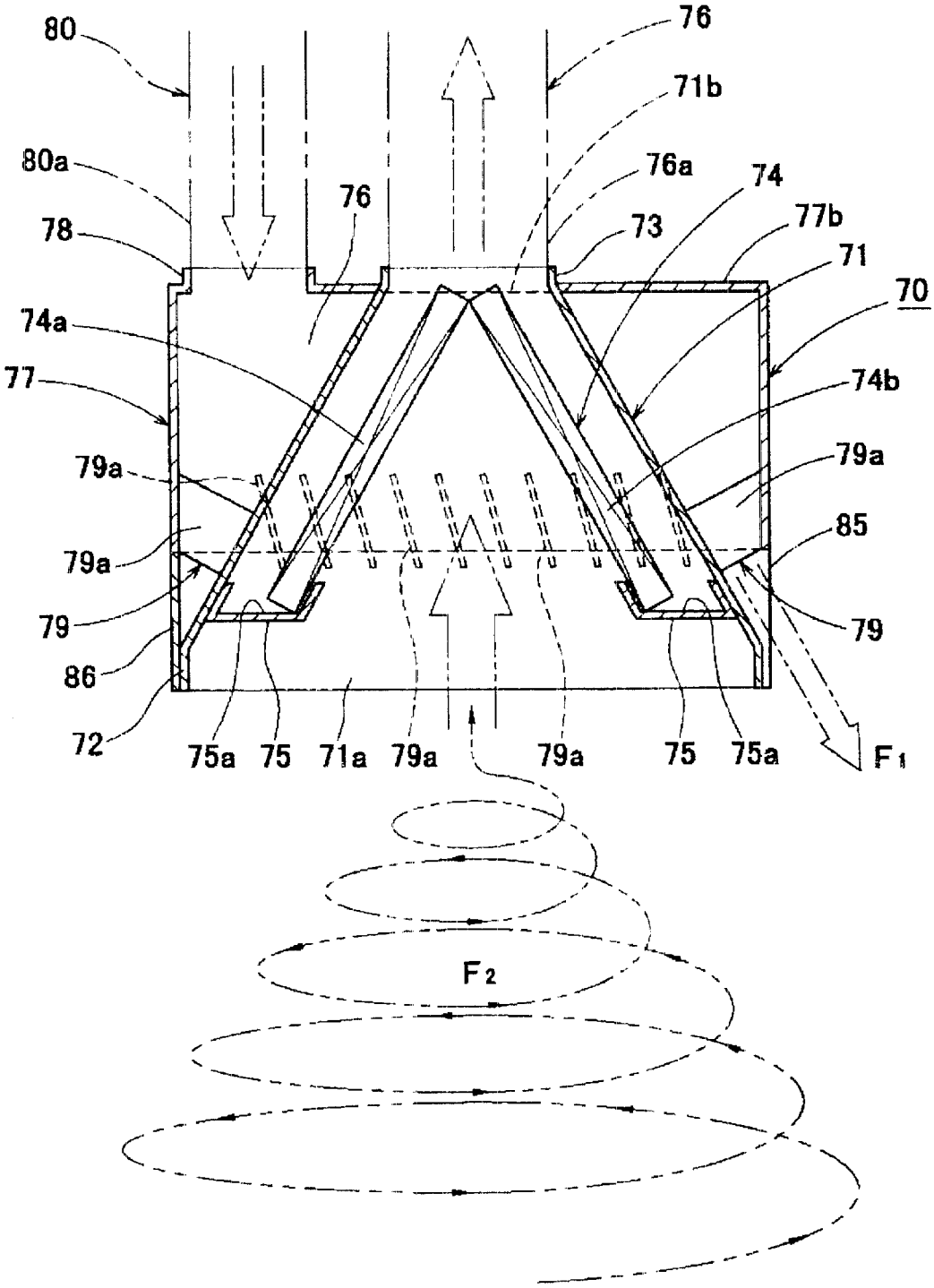
FIG. 34 is a cross sectional view (cross sectional view taken along line B—B of FIG. 32) showing the constitution of the same device.

In addition, in the tornado type air intake and blowing device according to this embodiment, the device 70 portion is in a hexahedron shape as a whole, which facilitates installing the device in a corner area of a room where walls 91 and 92 cross at right angles as shown in FIGS. 30 and 31.

Embodiment 11

Further, FIGS. 32 through 37 show the constitution of a tornado type air intake and blowing device according to the embodiment 11 of the present invention similarly applied to a ventilator.

As described above, in the tornado type air intake and blowing device having the constitution as seen in the above embodiment 10, the device 70 portion is in a hexahedron shape as a whole, which certainly facilitates installation of the device in a corner area in a room where walls 91 and 92 cross at right angles as shown in FIGS. 30 and 31.

However, as shown in FIGS. 30 and 31, where the device is installed in the corner area of a room, the air blowing ports 79, 79 on the right plane side and the back plane side are each in contact with or in the vicinity of the walls 91 and 92, so that a stable spiral airflow is not blown from these air blowing ports 79, 79. Consequently, the airflow tends to be turbulent in these (A) and (B) sections (see FIGS. 31), which affects the entire device and disturbs formation of a stable spiral airflow F1

This embodiment is constituted to cope with this kind of problem, and characterized in that each of the air blowing ports 79, 79 on the right plane side and back plane side is entirely blocked by blocking plates 85 and 86 in vertical direction which are disposed to extend downward from the upper side of the corresponding side wall 77*a*, 77*a* of the air supply chamber 77, and only the air blowing ports 79 on the left plane side and the front plane side not facing the wall surface are open. Other elements of the constitution is identical to the above embodiment 10.

Figure 35:
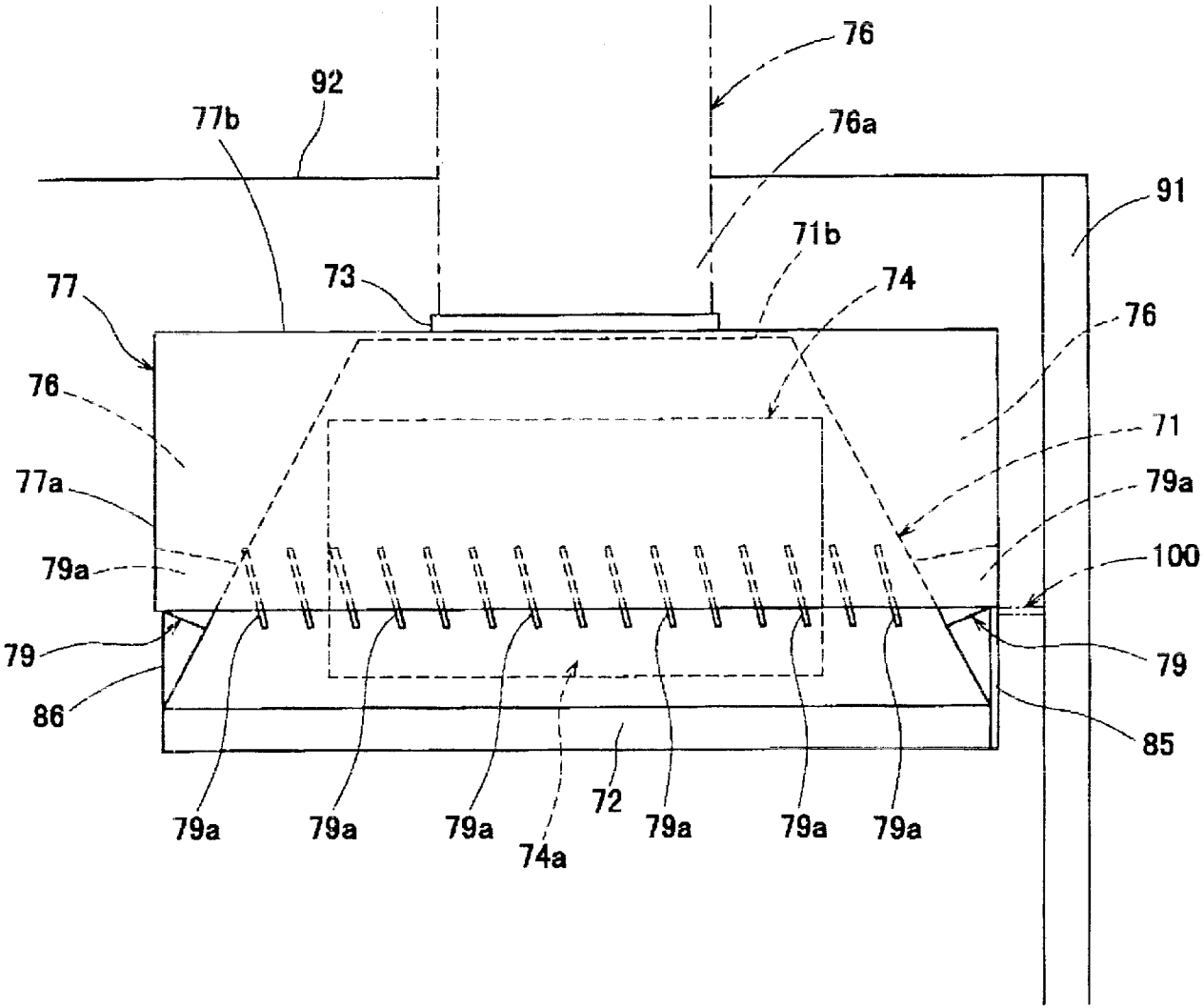
FIG. 35 is a front view showing an installation configuration example of the same device.
Figure 36:
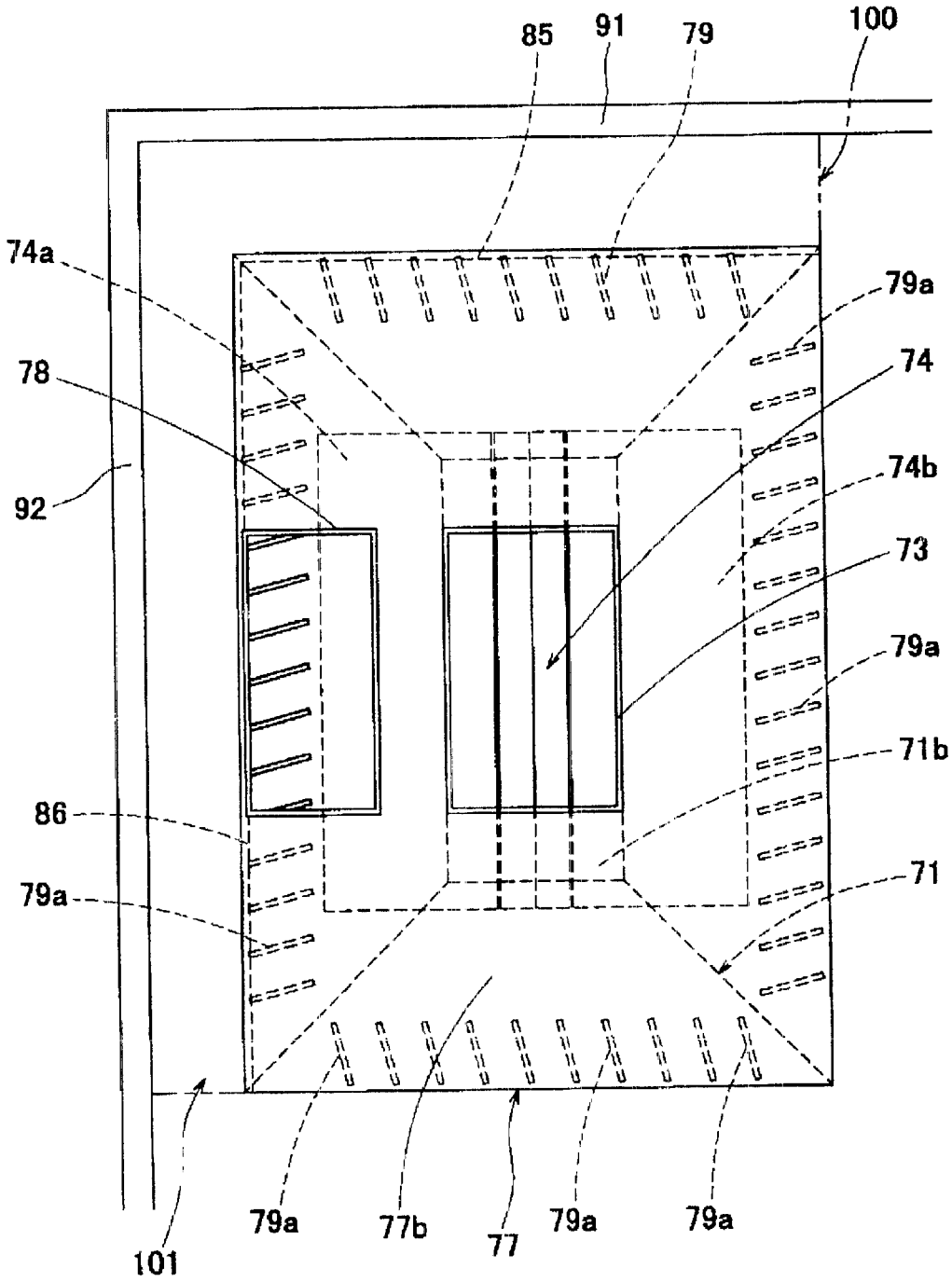
FIG. 36 is a plane view showing the installation configuration example of the same device.
Figure 37:
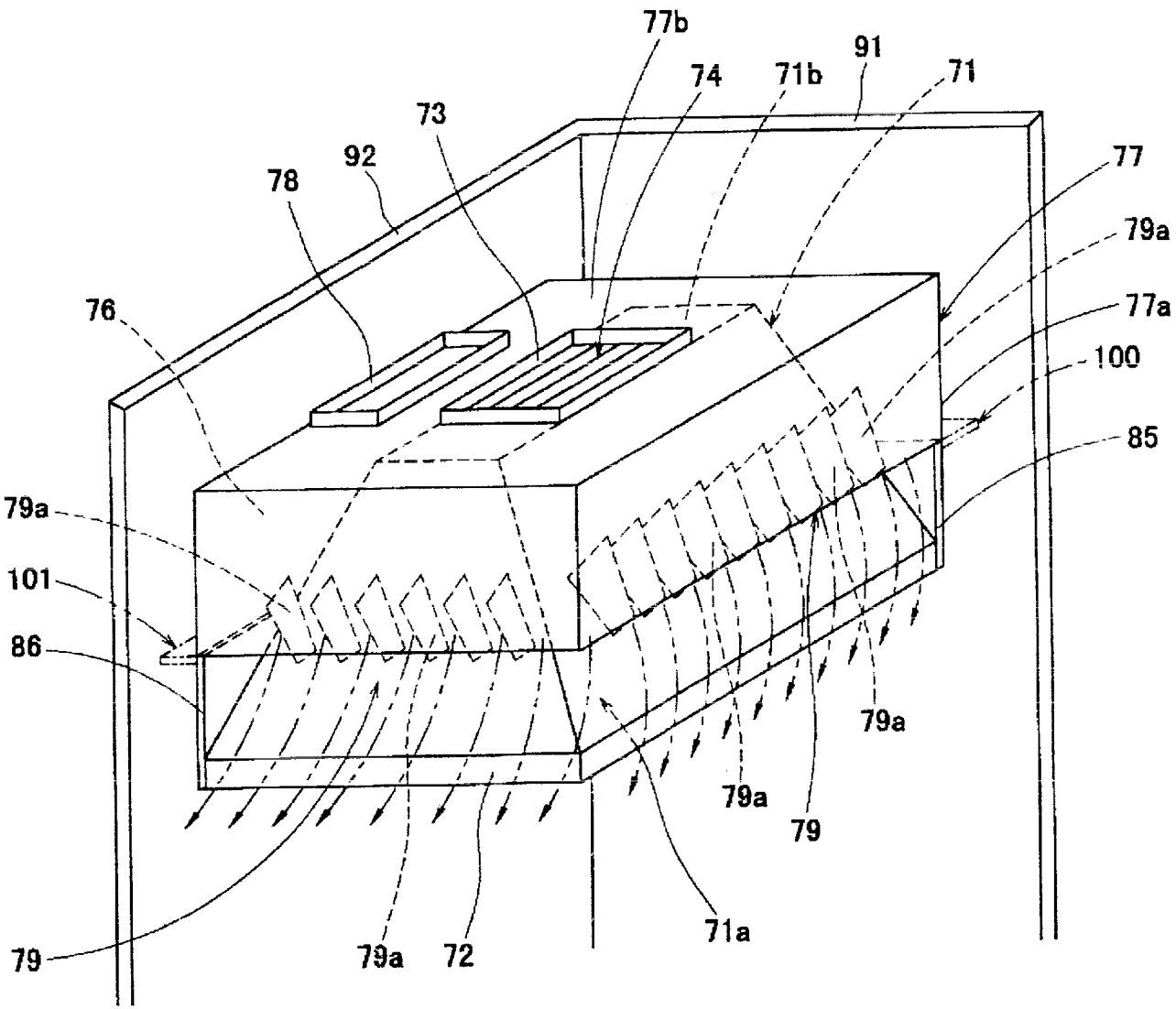
FIG. 37 is a perspective view showing the installation configuration example of the same device.
Figure 38:
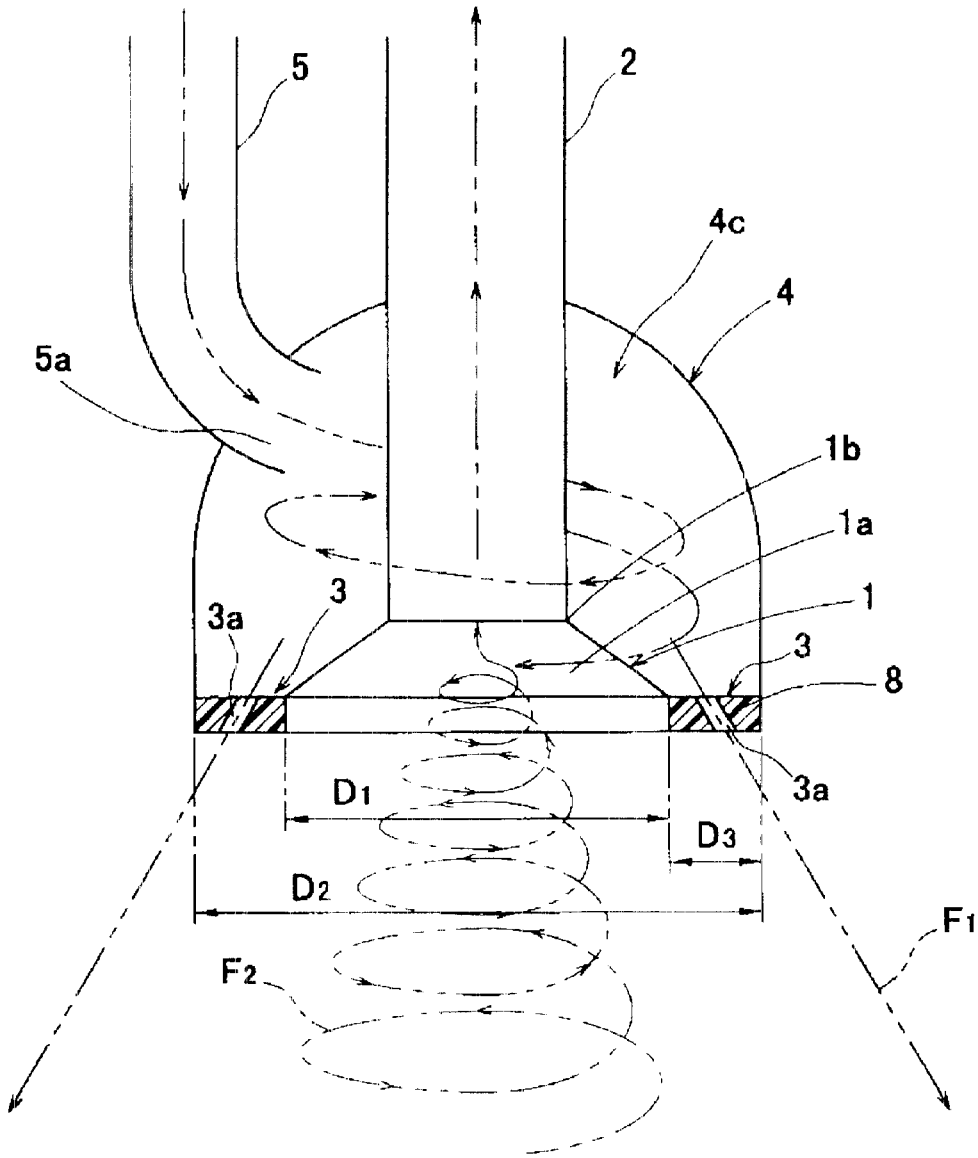
Fig. 38 PRIOR ART
FIG. 38 is a cross sectional view showing constitution of a conventional tornado type air intake and blowing device.

According to such constitution, even if a specified space is present, as shown in FIGS. 35 through 37, between the right plane side and the wall 91 and between the back plane side and the wall 92, no airflow is blown from these parts. Therefore, there is generated no turbulence against spiral airflow blown-off from the left plane side and the front plane side. Accordingly, the indoor air in a local area, which is surrounded by an effective spiral airflow F1 generated outside the walls from the spiral blowoff airflow and by the walls 91 and 92, can be sucked to the upper central area as effectively as possible and exhausted from the intake hood 71 toward the exhaust duct 76 direction.

It is noted that if space is further present between the walls 91 and 92 and the device 70 in the above case as shown in the drawings, one preferable measure is to block the space with specified horizontal plates 100 and 101 or the like as shown with a virtual line in FIGS. 35 through 37.

In such constitution, the space itself in vertical direction between the device 70 and the walls 91 and 92 is sealed, which enables reliable sealing effectiveness in the walls 91 and 92 where the air curtain airflow is disturbed to be formed.

What is claimed is:

1. A tornado type air intake and blowing device, comprising:

an exhaust port communicating with an exhaust duct;

an air supply chamber disposed to enclose the exhaust port and to which air is supplied through an air supply inlet; and an air blowing port for blowing the air supplied to an inside of the air supply chamber from an outer periphery of the exhaust port diagonally downward, wherein the air blowing port is formed slantwise at a specific inclination angle from an upper position on an inside wall of the air supply chamber to a lower position on an outside wall thereof.

2. The tornado type air intake and blowing device as defined in claim 1, further comprising a plurality of air blowing ports provided continuously on a circumference of a side wall of the air supply chamber.

3. The tornado type air intake and blowing device as defined in claim 1, further comprising a plurality of air blowing ports, wherein each of said air blowing ports is formed at a specified interval on a circumference of a side wall of the air supply chamber.

4. A tornado type air intake and blowing device, comprising:

an exhaust port for taking indoor air; and air blowing ports for blowing the air from an outer periphery of the exhaust port diagonally downward, wherein the air blowing ports are formed slantwise at a specific inclination angle from an upper position on the inside wall of the air intake and blowing device to a lower position on the outside wall thereof.

5. The tornado type air intake and blowing device as defined in claim 4, wherein an outer peripheral edge of each of the air blowing ports is positioned higher than an air suction plane of an intake hood provided to surround the exhaust port, and positioned inside of the outer peripheral edge thereof.

6. The tornado type air intake and blowing device as defined in claim 5, wherein the air blowing ports and the exhaust port are placed offset to each other in vertical reverse directions along a vertical central axis.

7. The tornado type air intake and blowing device as defined in claim 4, wherein the air blowing ports are continuously provided in a circumferential direction of the device.

8. A tornado type air intake and blowing device, comprising:

an exhaust port communicating with an exhaust duct;

a circular air supply chamber disposed to enclose the exhaust port and to which air is supplied through an air supply inlet; and an air blowing port provided on a side wall of the air supply chamber, the air port being formed at an oblique angle to a tangent of a circumference of the air supply chamber and slanting downward from an upper position on an inside of the side wall to a lower position on an outside of the side wall.

9. The tornado type air intake and blowing device as defined in claim 8, further comprising a plurality of air blowing ports provided continuously on a circumference of the side wall of the air supply chamber.

10. The tornado type air intake and blowing device as defined in claim 8, further comprising a plurality of air blowing ports, wherein each of said air blowing ports is formed at a specified interval on a circumference of the side wall of the air supply chamber.

* * * * *